US007588322B2

(12) United States Patent
Ohnishi et al.

(10) Patent No.: US 7,588,322 B2
(45) Date of Patent: Sep. 15, 2009

(54) LIQUID DROP DISCHARGE PIEZOELECTRIC DEVICE

(75) Inventors: Takao Ohnishi, Nishikasugai-Gun (JP); Kazuhiro Yamamoto, Nagoya (JP); Yoshihiro Iseki, Nagoya (JP); Koji Kimura, Nagoya (JP); Toshikazu Hirota, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 268 days.

(21) Appl. No.: 11/669,608

(22) Filed: Jan. 31, 2007

(65) Prior Publication Data

US 2007/0120899 A1 May 31, 2007

Related U.S. Application Data

(63) Continuation of application No. PCT/JP2005/017752, filed on Sep. 27, 2005.

(30) Foreign Application Priority Data

Sep. 30, 2004 (JP) ..... 2004-289450

(51) Int. Cl.
*B41J 2/045* (2006.01)

(52) U.S. Cl. ..... 347/68

(58) Field of Classification Search ..... 347/68, 347/69–72, 54–56; 400/124.16
See application file for complete search history.

(56) References Cited

U.S. PATENT DOCUMENTS

| | | | | |
|---|---|---|---|---|
| 6,168,255 | B1 | 1/2001 | Nagashima | |
| 7,160,511 | B2 | 1/2007 | Takahashi et al. | |
| 2001/0015740 | A1 | 8/2001 | Kitahara | |
| 2006/0152556 | A1 * | 7/2006 | Sugahara | 347/71 |

FOREIGN PATENT DOCUMENTS

| | | | |
|---|---|---|---|
| JP | 07-040536 | | 2/1995 |
| JP | 07-081055 | | 3/1995 |
| JP | 07-329291 | A1 | 12/1995 |
| JP | 08-187865 | A1 | 7/1996 |
| JP | 09-169110 | A1 | 6/1997 |
| JP | 10-109411 | A1 | 4/1998 |
| JP | 2000-006400 | | 1/2000 |
| JP | 2001-235400 | | 8/2001 |
| JP | 2001-270117 | A1 | 10/2001 |
| WO | WO 96/41721 | A1 | 12/1996 |

* cited by examiner

*Primary Examiner*—K. Feggins
(74) *Attorney, Agent, or Firm*—Burr & Brown

(57) ABSTRACT

A liquid droplet discharging piezoelectric device 1 provided with a cavity member 11 with a built-in cavity 3; an introduction member 13 having introduction channel 5 connecting with the cavity 3; and a nozzle member 12 having nozzle channel 4 connecting with the cavity 3 on a side opposite to the channel 5. This liquid droplet discharging piezoelectric device 1 is provided with an introduction port 6, attached to the introduction member 13, capable of introducing a liquid into the cavity 3 via the introduction channel 5, and a discharge port 7, attached to the nozzle member 12, capable of discharging as droplets a liquid filled in the cavity 3 via the nozzle channel 40. Even in a case where an amount of liquid droplets is of a nanoliter (nl) order, excellent stability and reproducibility are attained, and the unit can stably be operated when attached to an apparatus.

27 Claims, 15 Drawing Sheets

LIQUID DROP DISCHARGE PIEZOELECTRIC DEVICE

TECHNICAL FIELD

The present invention relates to a liquid droplet discharge device having a structure in which a cavity (member) to be filled with a liquid is integrated with a nozzle (member) to discharge the liquid as droplets, the device being capable of easily treating micro liquid droplets of an nl order with good reproducibility.

BACKGROUND ART

In recent years, discharge means of micro liquid droplets is used as production means of products or the like in any field. The micro liquid droplet discharge means is used as, for example, ink discharge means in a printing apparatus; means for discharging and dispensing a predetermined liquid in a field of medical treatment, manufacturing organs of living body, drugs, food or the like; and means for forming an electrode film in a manufacturing process of a fuel cell or an electronic component. Especially in a blood analysis unit in the medical field, a genetic inspection unit or an inspection unit for new drug inspection or the like, for running cost reduction or throughput improvement, miniaturization is demanded to change the existing minimum discharge amount (dispensing amount) of a microliter (μl) order to that of a nanoliter (nl) order, and liquid droplet discharge means is required which is capable of stably discharging the droplets as much as the discharge amount of the nl order with good reproducibility. In a unit for forming the electrode film, means capable of discharging the liquid droplets of the nl order in a non-contact manner is expected in order to stably form a film having a uniform thickness.

To meet such a demand, for example, in Patent Document 1, an ink jet head which deposits ink liquid droplets onto an image recording medium is disclosed. The disclosed ink jet head is an ink jet head composed by bonding, to a substrate in which an ink jet port is formed, a piezoelectric element block formed by laminating a plurality of plate-like piezoelectric materials via a conductive material, and having hollowed portions composing a pressure chamber; and then bonding, to the piezoelectric element block, a lid in which an ink supply port is formed, and changes a volume of the pressure chamber by displacements of piezoelectric elements composing the piezoelectric element block.

Moreover, in Patent Document 2, there is proposed a metal liquid jet unit equipped with a liquid filling portion; a liquid injection port; a liquid jet port to jet the liquid; and a bimorph or unimorph type piezoelectric element to drive and jet the liquid, and channels are formed in series on the piezoelectric element.

Furthermore, in Patent Document 3, means for imparting an inertial force to the liquid to discharge the liquid is proposed. A disclosed liquid dispensing unit is a unit having a liquid holding member (a container which holds a discharge nozzle and a solution); and driving means (a piezoelectric element) for moving the liquid holding member, and the unit moves the liquid holding member with the driving means (accelerates the discharge nozzle to thereby impart the inertial force to the liquid), thereby discharging the liquid droplets. Furthermore, as another prior document, Patent Document 4 is known.

Patent Document 1: Japanese Patent Application Laid-Open No. 7-81055;

Patent Document 2: Japanese Patent Application Laid-Open No. 2000-6400;

Patent Document 3: Japanese Patent Application Laid-Open No. 2001-235400; and

Patent Document 4: Japanese Patent Application Laid-Open No. 7-40536.

DISCLOSURE OF THE INVENTION

However, the means disclosed in Patent Documents 1, 2 are devices which discharge micro liquid droplets as much as an amount of a picoliter (pl) order. In order to obtain a discharge amount of a nl order, the liquid droplets need to be discharged a large number of times, and much time is required because the droplets are discharged many times. Furthermore, since micro liquid droplets have a large surface area, a liquid solvent easily volatilizes during flying. In a case where a long discharge time is required, when an environment where the droplets are discharged changes, a volatilization amount fluctuates owing to an influence of the change, and a liquid amount is not necessarily reproduced satisfactorily.

Moreover, the liquid dispensing unit disclosed in Patent Document 3 has a constitution in which driving means (a piezoelectric element) is connected to a liquid holding portion via a connecting portion. Therefore, when a liquid holding member is moved, the connecting portion also vibrates, the liquid holding member does not perform a predetermined operation in some cases, and a discharge operation might be unstable.

In addition, a method is known in which a cylinder of a micro syringe is precisely controlled to thereby dispense a liquid amount of the nl order, but the liquid cannot be supplied in a non-contact manner. Therefore, a liquid in a stylus is pulsed to a portion wherein the liquid has been supplied, the liquid amount fluctuates, and the method has a poor reproducibility and lacks in accurateness.

As described above, at present, any liquid droplet discharge means is not realized that can be operated as much as the discharge amount of the nl order with good reproducibility and that can stably operate when attached to the unit. The present invention has been developed in view of problems of such a conventional technology, and an object thereof is to provide liquid discharge means which has an excellent stability and reproducibility of an amount of liquid droplets especially in a case where the amount of the liquid droplets is of a nl order and which can stably operate when attached to a device.

As a result of intensive investigation performed in order to achieve the above object, it has been found that the above object can be achieved by integrating a cavity (member) to pool a liquid and a nozzle (member) to discharge the liquid in liquid droplet discharge means; and using a piezoelectric element (a piezoelectric driving body) as driving means, and the present invention has been completed.

That is, first, according to the present invention, there is provided liquid droplet discharging piezoelectric device for use in discharging micro liquid droplets provided with a cavity member in which a cavity to be filled with a liquid is built; an introduction member having an introduction channel which connects with the cavity and an introduction port from which the liquid is introduced into the cavity via the introduction channel; and a nozzle member having a nozzle channel which connects with the cavity on a side of the cavity member opposite to the introduction channel and a discharge port to discharge the liquid with which the cavity has been filled as droplets via the nozzle channel, wherein at least a part of the cavity member comprises a piezoelectric driving body in which a plurality of layered piezoelectric bodies made of a ceramic material and a plurality of layered electrodes are alternately laminated, at least a part of the introduction member and/or the nozzle member comprises a piezoelectric body made of the ceramic material, the cavity member, the introduction member and/or the nozzle member being integrally formed by sintering, a displacement based on an electrically inductive strain of the piezoelectric driving body comprising at least a part of the cavity member generates a pressing force accompanied by an increase of a pressure in the cavity of the cavity member; and the liquid with which the cavity has been filled is discharged as droplets from the discharge port by use of the pressing force.

Here, there are electrically inductive strains due to a lateral effect and a longitudinal effect. Among them, the lateral effect indicates deformation of the piezoelectric driving body which expands and contracts in a vertical direction at a time when an electric field is applied in a polarized direction. In the liquid droplet discharging piezoelectric device according to the present invention, for example, in a case where a liquid flow direction corresponding to a direction from the introduction port to the discharge port crosses, at right angles, a laminating direction of the plurality of layered piezoelectric bodies forming the piezoelectric driving body, when the piezoelectric body is polarized in the laminating direction and the electric field is applied in the same direction as the polarizing direction, the displacement of the piezoelectric driving body expands and contracts the cavity member in the liquid flow direction.

Moreover, the longitudinal effect of the electrically inductive strain indicates the deformation of the piezoelectric driving body which expands and contracts in the same direction as that of the electric field applied in the polarizing direction. In the liquid droplet discharging piezoelectric device according to the present invention, for example, in a case where the liquid flow direction corresponding to the direction from the introduction port to the discharge port crosses, at right angles, the laminating direction of the plurality of layered piezoelectric bodies forming the piezoelectric driving body, when the piezoelectric body is polarized in the laminating direction and the electric field is applied in the same direction as the polarizing direction, the displacement of the piezoelectric driving body expands and contracts the cavity member in a direction vertical to the liquid flow direction. Since the expansion and contraction in the direction vertical to the liquid flow direction result in an operation to narrow or broaden the cavity of the cavity member, the operation increases the pressure in the cavity to generate the pressing force. A mechanism to generate the pressing force in the cavity by the displacement based on the longitudinal effect of the electrically inductive strain of the piezoelectric driving body is also applied to a case where at least a part of the nozzle member and the introduction member comprises the piezoelectric driving body in a preferable mode described later regardless of the cavity member.

In the liquid droplet discharging piezoelectric device according to the present invention, in a case where at least a part of the introduction member comprises the piezoelectric bodies made of the ceramic material, it is preferable that the piezoelectric bodies are the plurality of layered piezoelectric bodies and that the plurality of layered piezoelectric bodies and the plurality of layered electrodes are alternately laminated to compose the piezoelectric driving body.

In the liquid droplet discharging piezoelectric device according to the present invention, in a case where at least a part of the nozzle member comprises the piezoelectric bodies made of the ceramic material, it is preferable that the piezoelectric bodies are the plurality of layered piezoelectric bodies and that the plurality of layered piezoelectric bodies and the plurality of layered electrodes are alternately laminated to compose the piezoelectric driving body.

In the liquid droplet discharging piezoelectric device according to the present invention, it is preferable that the whole cavity member comprises the piezoelectric driving body.

Moreover, in a case where the whole cavity member comprises the piezoelectric driving body, a section of the cavity incorporated in the cavity member vertical to the liquid flow direction has a rectangular shape.

Furthermore, in the liquid droplet discharging piezoelectric device according to the present invention, it is preferable that the cavity member has a prismatic shape, the cavity is defined by two sets of opposite wall portions, one set of opposite wall portions comprises the piezoelectric driving bodies, and the other set of wall portions comprises the piezoelectric bodies only.

That is, in this case, when the cavity member has a prismatic shape, the cavity is formed by two sets of opposite wall portions, one set of opposite wall portions comprises the piezoelectric driving bodies and the other set of wall portions comprises the piezoelectric bodies only, in the liquid droplet discharging piezoelectric device according to the present invention, it is further preferable that the introduction member has a prismatic shape, the introduction channel is formed by two sets of opposite wall portions, one set of opposite wall portions (of them) comprises the piezoelectric driving bodies, and the other set of wall portions comprises the piezoelectric bodies only; the nozzle member has a prismatic shape, the nozzle channel is formed by two sets of opposite wall portions, one set of opposite wall portions (of them) comprises the piezoelectric driving bodies, and the other set of wall portions comprises the piezoelectric bodies only; and, in the cavity member, the introduction member and the nozzle member, one set of opposite wall portions comprising the piezoelectric driving bodies in the cavity member are arranged in the same positions as those in the introduction member, and the wall portions in the nozzle member only are arranged in different positions. This means that, in a case where the member has the prismatic shape, since there are only two sets of opposite wall portions, the same one set among them comprise the piezoelectric driving bodies in the cavity member and the introduction member, and the other set comprises the piezoelectric driving bodies in the nozzle member.

Moreover, in the liquid droplet discharging piezoelectric device according to the present invention, it is preferable that the cavity member has a prismatic shape, the cavity is formed by two sets of opposite wall portions, and the two sets of opposite wall portions both comprise the piezoelectric driving bodies.

Furthermore, in a case where the two sets of opposite wall portions both comprise the piezoelectric driving bodies, it is preferable that among the two sets of opposite wall portions both comprising the piezoelectric driving bodies, a polarized direction of the piezoelectric bodies of the piezoelectric driving bodies composing one set of opposite wall portions is different from that of the piezoelectric bodies of the piezoelectric driving bodies composing the other set of opposite wall portions.

It is judged by a relation between the polarized direction and a direction of the electric field applied to the piezoelectric body whether or not the polarized directions are different from each other. For example, in a case where the polarized direction of the piezoelectric bodies of the piezoelectric driving bodies composing one set of opposite wall portions is the same direction as the electric field direction, if the polarized direction of the piezoelectric bodies of the piezoelectric driving bodies composing the other set of opposite wall portions is, for example, a direction opposite to the electric field direction, it is judged that the polarized directions are different from each other.

In addition, it is preferable that any of the two sets of opposite wall portions both comprising the piezoelectric driving bodies is provided with a slit which partially separates the piezoelectric driving bodies composing one set of opposite wall portions from the piezoelectric driving bodies composing the other set of opposite wall portions.

In the liquid droplet discharging piezoelectric device according to the present invention, in a case where the cavity member has a prismatic shape and the cavity is formed by two sets of opposite wall portions, it is preferable that in the wall portion comprising the piezoelectric driving body among the two sets of opposite wall portions, the layered electrodes stand back from a surface forming the cavity and are not exposed in the surface forming the cavity, and the surface forming cavity (the surface forming cavity) comprises the layered piezoelectric bodies only. Moreover, a ratio between a distance from the surface forming cavity to the layered electrodes (referred to as the standing back distance) and a thickness of one layer of the layered piezoelectric bodies is in a range of 5:1 to 1:10, more preferably 2:1 to 1:5. In this preferable mode, the layered electrodes stand back from the surface forming cavity as much as a predetermined dimension (distance) to leave the surface forming cavity, are formed (present) at the wall portion, and do not appear on the surface forming cavity, and the surface forming cavity comprises the layered piezoelectric bodies only. From the surface forming cavity to the (layered) electrodes, the piezoelectric body is not sandwiched between the electrodes. Even in the wall portion comprising the piezoelectric driving body obtained by laminating the piezoelectric bodies and the electrodes, a portion indicated by the above stand back distance consists of the piezoelectric body only. Moreover, the above ratio is represented by a ratio between the standing back distance and the thickness of the piezoelectric body.

In the liquid droplet discharging piezoelectric device according to the present invention, it is preferable that all members consisting of the cavity member, the introduction member and the nozzle member are integrally formed by laminating the plurality of layered piezoelectric bodies made of the ceramic material and that the cavity of the cavity member, the introduction channel of the introduction member and the nozzle channel of the nozzle member are defined by the same layer of the laminated piezoelectric bodies. This means that the cavity, the introduction channel and the nozzle channel are positioned and formed at a portion corresponding to one layer of the piezoelectric body ranging from the cavity member to the introduction member and the nozzle member.

In the liquid droplet discharging piezoelectric device according to the present invention, it is preferable that a section of the nozzle channel of the nozzle member vertical to the liquid flow direction is smaller than the section of the cavity of the cavity member vertical to the liquid flow direction.

Furthermore, in this case, it is preferable that a size of the section of the cavity of the cavity member is continuously reduced on a nozzle channel side of the cavity to smoothly connect the cavity to the nozzle channel of the nozzle member.

Moreover, it is preferable that the section of the nozzle channel of the nozzle member vertical to the liquid flow direction has a rectangular or trapezoidal shape.

Furthermore, in a case where the section of the nozzle channel vertical to the liquid flow direction has the rectangular or trapezoidal shape, it is preferable that a ratio d/L between the shortest distance d in the section of the nozzle channel of the nozzle member and a length L of the nozzle channel is 0.08 to 0.8.

The shortest distance d in the section of the nozzle channel is equal to a length of a shorter side of the section of the nozzle channel vertical to the liquid flow direction in a case where the section has the rectangular shape, and the distance corresponds to either a height or a length of the shorter side of parallel sides in a case where the section has the trapezoidal shape.

In the liquid droplet discharging piezoelectric device according to the present invention, it is preferable that a surface roughness of an end surface of the nozzle member on a discharge port side is smaller than at least a surface roughness of the nozzle channel of the nozzle member.

Here, the surface roughness indicates a surface roughness according to Japanese Industrial Standards B0601 "Surface Roughness-Definition and Display". As to the surface roughness, a surface roughness Ra is a center line average roughness determined in Japanese Industrial Standards B0601-1982, and corresponds to a value obtained by turning back a roughness curve from the center line; and dividing, by a length L, an area defined by the roughness curve and the center line. In general, the value is read directly from graduations displayed in a surface roughness measuring instrument. As to the surface roughness, a surface roughness Rt is synonymous with the maximum height Rmax defined by a difference between the highest point and the lowest point in a measurement surface. Either the surface roughness Ra or the surface roughness Rt can be used as the surface roughness according to the present invention, and either one may be used in judgment.

In the liquid droplet discharging piezoelectric device according to the present invention, it is preferable that a section of the introduction channel of the introduction member vertical to the liquid flow direction is smaller than that of the cavity of the cavity member vertical to the liquid flow direction and that a size of the section of the cavity of the cavity member is continuously reduced in a width direction with respect to the liquid flow direction on an introduction channel side of the cavity to smoothly connect the cavity to the introduction channel of the introduction member. It is to be noted that the width direction of the cavity is a direction vertical to both of the laminating direction and the liquid flow direction, and is the same direction as a width direction of the wall portion or the piezoelectric body. A width of the cavity is a dimension (a length) of the cavity in a direction (the width direction) of the cavity and corresponds to a distance between the surface forming cavity. These also apply to the nozzle channel and the introduction channel.

Furthermore, it is preferable that the section of the introduction channel of the introduction member vertical to the liquid flow direction has a rectangular or trapezoidal shape.

In the liquid droplet discharging piezoelectric device according to the present invention, it is preferable that the introduction channel of the introduction member comprises a porous body having a gas liquid separating function.

Examples of the porous body having the gas liquid separating function for use include porous bodies of a ceramic, a metal and a polymer material. Above all, film-like polypropylene is preferably usable.

In the liquid droplet discharging piezoelectric device according to the present invention, it is preferable that the introduction member includes, on an introduction port side of the introduction channel, an introduction cavity which connects with the introduction channel and whose section vertical to the liquid flow direction is larger than the section of the introduction channel.

In the liquid droplet discharging piezoelectric device according to the present invention, it is preferable that the introduction member comprises a flange portion to be attached to an apparatus to which the liquid droplet discharging piezoelectric device is to be applied and that at least an end surface of the introduction member on the introduction port side is larger than the section of the cavity member vertical to the liquid flow direction.

The larger surface means that, when the end surface of the introduction member on the introduction port side and the section of the cavity member are superimposed on the surface vertical to the liquid flow direction, the end surface on the introduction port side includes all the section of the cavity member. Moreover, since the introduction member comprises the flange portion, an area of the end surface on the introduction port side is set to be larger than the section of the cavity member.

In the liquid droplet discharging piezoelectric device according to the present invention, it is preferable that the cavity of the cavity member, the nozzle channel of the nozzle member and the introduction channel of the introduction member have sections having the same shape and an equal width in the width direction with respect to the liquid flow direction and that the sections are continuously connected to one another.

The liquid droplet discharging piezoelectric device according to the present invention is preferably used in a case where micro liquid droplets have a liquid amount of a nanoliter (nl) order.

In the liquid droplet discharging piezoelectric device according to the present invention, it is preferable that any electrode is not exposed on the end surface of the introduction member on the introduction port side, a surface forming introduction channel of the introduction member, the surface forming cavity of the cavity member, a surface forming nozzle channel of the nozzle member and the end surface of the nozzle member on the discharge port side.

In the liquid droplet discharging piezoelectric device according to the present invention, it is preferable that the liquid flow direction crosses, at right angles, the laminating direction of the plurality of layered piezoelectric bodies forming the piezoelectric driving body.

In the liquid droplet discharging piezoelectric device according to the present invention, it is preferable that the electrodes are disposed on opposite outermost layers in the piezoelectric driving body composed by alternately laminating the plurality of layered piezoelectric bodies and the plurality of layered electrodes and that the electrode of one outermost layer has a polarity different from that of the electrode of the other outermost layer.

The opposite outermost layers mean the outermost layers on opposite sides of the laminating direction of the piezoelectric bodies and the electrodes, and indicate surfaces opposing to the outside.

In the liquid droplet discharging piezoelectric device according to the present invention, in a case where at least a part of the cavity member, the nozzle member and the introduction member comprise the piezoelectric driving body, it is preferable that the piezoelectric body is a ceramic piezoelectric body and that the cavity member, the nozzle member and the introduction member comprising the piezoelectric driving body including the piezoelectric body are integrally formed by sintering.

In the liquid droplet discharging piezoelectric device according to the present invention, at least a part of the cavity member includes the piezoelectric driving body composed by alternately laminating the plurality of layered piezoelectric bodies made of the ceramic material and the plurality of layered electrodes, and the displacement based on the electrically inductive strain of the piezoelectric driving body is used. Therefore, a displacement amount of the body is large. Since at least a part of the introduction member and/or the nozzle member comprises the piezoelectric body made of the ceramic material and the cavity member, the introduction member and/or the nozzle member are integrally formed by the sintering, the displacement (or energy) is not absorbed, and is efficiently transmitted to the liquid with which the cavity has been filled. Therefore, the present device can discharge liquid droplets larger than those from a conventional piezoelectric driving device, and the device is preferable as a discharge device of the liquid droplets of the nl order.

In the preferable mode of the liquid droplet discharging piezoelectric device according to the present invention, the displacement based on the lateral effect of the electrically inductive strain of the piezoelectric driving body is used together with the displacement based on the longitudinal effect of the electrically inductive strain of the piezoelectric driving body to generate the pressing force in the cavity of the cavity member. Therefore, it is possible to increase a change of volume of the cavity with a small driving voltage. Therefore, the device can discharge the liquid droplets larger than those of the conventional piezoelectric driving device, and is suitable as the discharge device of the liquid droplets of the nl order. In addition, when at least a part of the cavity is bent with the displacement based on the lateral effect of the electrically inductive strain of the piezoelectric driving body, it is possible to change the change of volume of the cavity with a smaller driving voltage.

In the preferable mode of the liquid droplet discharging piezoelectric device according to the present invention, since the whole cavity member comprises the piezoelectric driving body and the section of the cavity incorporated in the cavity member vertical to the liquid flow direction is formed into the rectangular shape, there is not any inactive portion comprising the piezoelectric body only, and it is possible to increase the change of volume of the cavity with the small driving voltage. Therefore, the device can discharge the liquid droplets larger than those of the conventional piezoelectric driving device, and is suitable as the discharge device of the liquid droplets of the nl order.

In the preferable mode of the liquid droplet discharging piezoelectric device according to the present invention, since the cavity member has the prismatic shape, the cavity is defined by two sets of opposite wall portions and the only one set of opposite wall portions comprises the piezoelectric driving body, the cavity can be deformed in one direction, and a discharge direction of the liquid droplet is stabilized. Therefore, a discharge position can be controlled with high precision.

In the preferable mode of the liquid droplet discharging piezoelectric device according to the present invention, the cavity member has the prismatic shape, the cavity is defined by two sets of opposite wall portions, two sets of opposite wall portions both comprise the piezoelectric driving bodies, and the polarized direction of the piezoelectric body of the piezoelectric driving body comprising one set of opposite wall portions is set to be different from that of the piezoelectric body of the piezoelectric driving body comprising the other set of opposite wall portions. Therefore, when the same electric field is applied to the piezoelectric bodies, two sets of wall portions forming the cavity are deformed in the same direction, and the change of volume of the cavity can be increased with a small driving voltage. In consequence, the device can discharge the liquid droplets larger than those of the conventional piezoelectric driving device, and is suitable as the discharge device of the liquid droplets of the nl order.

In the preferable mode of the liquid droplet discharging piezoelectric device according to the present invention, the cavity member has the prismatic shape, two sets of opposite wall portions form the cavity, the two sets of opposite wall portions both comprise the piezoelectric driving bodies, and any of two sets of opposite wall portions is provided with the slit which partially separates the piezoelectric driving body comprising one set of opposite wall portions from the piezoelectric driving body comprising the other set of opposite wall portions. Therefore, a binding force with respect to the piezoelectric driving body drops, a bending displacement amount can be increased, and it is possible to increase the change of volume of the cavity with the small driving voltage. In consequence, the device can discharge the liquid droplets larger than those of the conventional piezoelectric driving device, and is suitable as the discharge device of the liquid droplets of the nl order.

In the preferable mode of the liquid droplet discharging piezoelectric device according to the present invention, in the wall portion comprising the piezoelectric driving body among two sets of opposite wall portions, the layered electrodes stand back from the surface forming cavity and are not exposed on the surface forming cavity, and the surface forming cavity comprises the layered piezoelectric bodies only. Moreover, the ratio between the distance (the standing back distance) from the surface forming cavity to the layered electrodes and the thickness of one layer of the layered piezoelectric bodies is in a range of 5:1 to 1:10. Therefore, in the mode in which any electrode is not exposed on the surface forming cavity, the drop of the displacement of the piezoelectric driving body can be suppressed. When the standing back distance unfavorably increases (a portion comprising the piezoelectric body only broadens in the width direction) and departs from the above range of the ratio between the standing back distance in the wall portion comprising the piezoelectric driving body and the thickness of one layer of the piezoelectric body, the displacement might remarkably drop with enlargement of an inactive portion (a portion comprising the only piezoelectric body which is not sandwiched between the electrodes). On the other hand, in a case where the standing back distance unfavorably decreases (the portion comprising the piezoelectric body only narrows in the width direction) and departs from the above range, when the device is prepared by a screen printing process, there is a possibility that the electrode is exposed on the surface forming cavity owing to a manufacturing fluctuation.

In the preferable mode of the liquid droplet discharging piezoelectric device according to the present invention, the cavity member, the introduction member and the nozzle member are all integrally formed by laminating the plurality of layered piezoelectric bodies made of the ceramic material. The cavity of the cavity member, the introduction channel of the introduction member and the nozzle channel of the nozzle member are defined by the same layer of the laminated piezoelectric body. Therefore, in the chamber from the introduction port for introducing the liquid to the discharge port for discharging the liquid, there is not any stepped portion in the laminating direction of the piezoelectric bodies, and an excellent bubble windup suppressing effect during the introducing of the liquid is produced.

In the preferable mode of the liquid droplet discharging piezoelectric device according to the present invention, in addition to the cavity member, at least a part of the nozzle member further comprises the piezoelectric driving body, and the pressing force can be generated in the liquid of the nozzle channel of the nozzle member by the displacement based on the electrically inductive strain of the piezoelectric driving body. Therefore, in addition to the displacement in the liquid flow direction (an axial direction of the nozzle) of the nozzle channel, contraction is applied in a direction substantially vertical to the flow direction of the liquid from the cavity member around the nozzle channel to constrict the liquid discharged from the nozzle. The liquid can be cut as the droplet owing to the generation of the constriction, and it is possible to improve the reproducibility of the discharge amount.

In the preferable mode of the liquid droplet discharging piezoelectric device according to the present invention, the section of the nozzle channel of the nozzle member vertical to the liquid flow direction is smaller than the section of the cavity of the cavity member vertical to the liquid flow direction. Furthermore, the section of the introduction channel of the introduction member vertical to the liquid flow direction is smaller than the section of the cavity of the cavity member vertical to the liquid flow direction. Therefore, the pressure in the cavity can efficiently be increased. Since the section of the nozzle channel of the nozzle member vertical to the liquid flow direction has the rectangular or trapezoidal shape and the nozzle member is easily formed from a laminated structure including the laminated layered piezoelectric bodies and layered electrodes, a manufacturing cost can be reduced. Moreover, since a meniscus is easily held by short sides, a large opening area (i.e., capable of discharging a large amount) can be maintained, and even a liquid having a low viscosity can be handled.

In the preferable mode of the liquid droplet discharging piezoelectric device according to the present invention, the ratio d/L between the shortest distance d in the section of the nozzle channel of the nozzle member and the length L of the nozzle channel is 0.08 to 0.8. Therefore, even if the large amount is discharged, any bubble is not involved in the cavity, and stability during the discharging can be secured.

In the preferable mode of the liquid droplet discharging piezoelectric device according to the present invention, since the surface roughness of the end surface of the nozzle member on the discharge port side is smaller than that of the nozzle channel of the nozzle member, water repellency of the nozzle can be improved without applying any water repellent agent or the like, and the liquid can easily be discharged as the droplets. Moreover, even the liquid having the low viscosity and a liquid having a low water repellency can be handled.

In the preferable mode of the liquid droplet discharging piezoelectric device according to the present invention, since the sections of the cavity of the cavity member, the nozzle channel of the nozzle member and the introduction channel of the introduction member in the width direction with respect to the liquid flow direction have the same shape and the equal width and are continuously connected to one another, the pressure in the cavity can efficiently be increased. Since the laminated structure including the laminated layered piezoelectric bodies and layered electrodes is easily formed, the manufacturing cost can be reduced.

In the preferable mode of the liquid droplet discharging piezoelectric device according to the present invention, the introduction channel of the introduction member comprises the porous body having the gas liquid separating function. Therefore, for example, if a treatment to make the introduction channel or the like vacuum is performed, the bubbles in the liquid can be reduced. Therefore, troubles such as discharge incapability due to the bubbles and pressure decay can be prevented, and a more stable discharge amount can be secured.

In the preferable mode of the liquid droplet discharging piezoelectric device according to the present invention, since the introduction member comprises the introduction cavity to store the liquid, a large number of dispensing operations can be performed with one filling operation, and which contributes to improvement of a production efficiency.

In the preferable mode of the liquid droplet discharging piezoelectric device according to the present invention, since the introduction member comprises the flange portion and the end surface of the introduction member on the introduction port side is larger than the section of the cavity member vertical to the liquid flow direction, sealability during the introducing of the liquid into the introduction channel improves. When the liquid is introduced into the introduction channel to fill the cavity by apparatus such as a pump or the like, fluctuations of an amount to be filled can be reduced, and a predetermined amount of the liquid can securely be introduced into the introduction channel.

In the preferable mode of the liquid droplet discharging piezoelectric device according to the present invention, any electrode is not exposed on the end surface of the introduction member on the introduction port side, the surface forming introduction channel of the introduction member, the surface forming cavity of the cavity member, the surface forming nozzle channel of the nozzle member and the end surface of the nozzle member on the discharge port side. Therefore, even when the liquid to be treated is an electrolytic solution or the like, the liquid can be handled.

In the preferable mode of the liquid droplet discharging piezoelectric device according to the present invention, the liquid flow direction crosses, at right angles, the direction in which the plurality of layered piezoelectric bodies forming the piezoelectric driving body are laminated. Therefore, the stepped portions of the laminated piezoelectric bodies are arranged in the liquid flow direction, and the introduction channel or the cavity can easily be filled without leaving any bubble.

In the preferable mode of the liquid droplet discharging piezoelectric device according to the present invention, since the electrodes are arranged on the opposite outermost layers of the piezoelectric driving body and the electrode of one outermost layer has a polarity different from that of the electrode of the other outermost layer, a wiring line treatment is easily performed. In addition, since the nozzle channel can be disposed at a central position of the liquid droplet discharging piezoelectric device in a thickness direction (the layered piezoelectric body laminating direction) and the discharge direction of the liquid droplets can be aligned with the central axis direction of the whole liquid droplet discharging piezoelectric device, the liquid droplet discharge direction can be aligned with the axial direction of the nozzle channel of the nozzle member. Therefore, the discharge position can easily be controlled, and precision of the discharge position can be improved.

DESCRIPTION OF REFERENCE NUMERALS

Figure 1A:
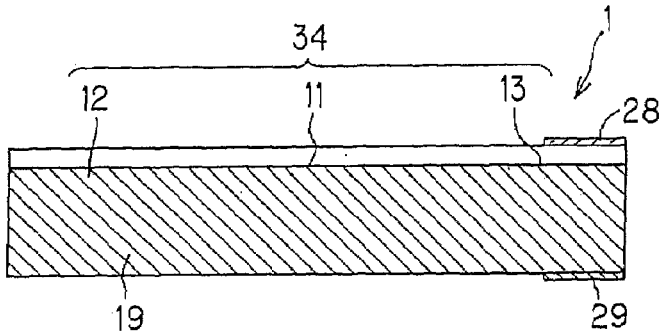
FIG. 1 is a diagram showing one embodiment of a liquid droplet discharging piezoelectric device according to the present invention, (a) is a plan view, (b) is a side view in a short direction (a right side view of (a)), (c) is a side view in a longitudinal direction (a lower side view of (a)) and (d) is a sectional view showing the AA section in (c)
Figure 1B:
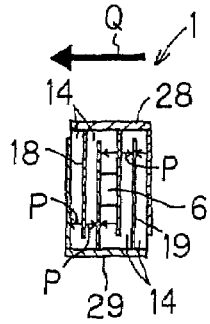
Figure 1C:
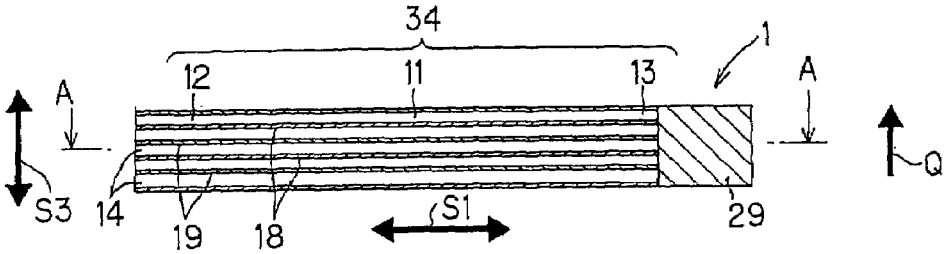
Figure 1D:
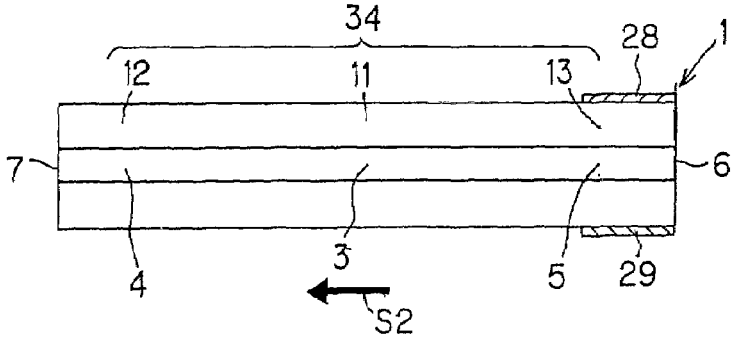

1, 102, 103, 104, 105, 106, 107, 108, 110, 111, 120, 140, 180, 190, 210 and 220: liquid droplet discharging piezoelectric device;

3, 53, 153, 253 and 353: cavity;

4, 54: nozzle channel;

5, 55 and 155: introduction channel;

6: introduction port;

7: discharge port;

11, 21, 121, 221, 321, 421, 521 and 621: cavity member;

12, 22, 122, 322 and 522: nozzle member;

13, 23, 123, 223, 323 and 523: introduction member;

15: flange portion;

16: porous body;

17: insulating portion;

18, 19: electrode;

25: slit;

28, 29: outer electrode;

30, 31, 32 and 33: wall portion;

34, 144, 154, 164, 174, 184, 194, 204, 284, 294, 304 and 314: piezoelectric driving body;

52: introduction cavity;

118, 119, 218 and 219: via hole;

230: inline type dispenser;

231: comb frame portion;

240: (conventional liquid droplet discharging piezoelectric device;

453: cavity;

454: nozzle channel; and

455: introduction channel.

BEST MODE FOR CARRYING OUT THE INVENTION

Embodiments of a liquid droplet discharging piezoelectric device according to the present invention will hereinafter be described appropriately with reference to the drawings, but the present invention should not be limited to them when interpreted. Without departing from the scope of the present invention, the present invention can variously be changed, modified, improved or replaced based on knowledge of any person skilled in the art. For example, the drawings show preferable embodiments of the present invention, but the present invention is not limited to configurations shown in the drawings or information shown in the drawings. When the present invention is performed or verified, means similar or equivalent to those described in the present description are applicable, but preferable means are the following means.

First, FIG. 1 is a diagram showing one embodiment of the liquid droplet discharging piezoelectric device according to the present invention, FIG. 1(*a*) is a plan view, FIG. 1(*b*) is a side view in a short direction (a right side view of FIG. 1(*a*)), FIG. 1(*c*) is a side view in a longitudinal direction (a lower side view of FIG. 1(*a*)) and FIG. 1(*d*) is a sectional view showing the AA line (a section which does not include any inner electrode) in FIG. 1(*c*).

As shown in FIGS. 1(*a*) to (*d*), a liquid droplet discharging piezoelectric device 1 includes a cavity member 11 in which a cavity 3 is built; an introduction member 13 having an introduction channel 5 which connects with the cavity 3; and a nozzle member 12 having a nozzle channel 4 which connects with the cavity 3 on a side opposite to the introduction channel 5. The introduction member 13 is provided with an introduction port 6 to introduce a liquid into the cavity 3 via the introduction channel 5. The nozzle member 12 is provided with a discharge port 7 to discharge the liquid with which the cavity 3 has been filled as droplets via the nozzle channel 4.

In the liquid droplet discharging piezoelectric device 1, sections of the cavity 3 of the cavity member 11, the nozzle channel 4 of the nozzle member 12 and the introduction channel 5 of the introduction member 13 vertical to a liquid flow direction shown by an arrow S2 have the same rectangular shape and an equal size, and they are continuously connected to one another and formed as one through hole. Therefore, boundaries among the cavity member 11, the nozzle member 12 and the introduction member 13 are not clearly shown.

Moreover, the cavity member 11, the introduction member 13 and the nozzle member 12 are all composed as a piezoelectric driving body 34 in which five layers of piezoelectric bodies 14 made of a ceramic material and six layers of electrodes 18, 19 made of a conductive material are alternately laminated in a laminating direction shown by an arrow Q, and integrally formed by sintering. That is, the whole liquid droplet discharging piezoelectric device 1 corresponds to the piezoelectric driving body 34. In the liquid droplet discharging piezoelectric device 1, the liquid flow direction (the arrow S2) crosses the laminating direction (the arrow Q) at right angles.

The electrodes 18, 19 are driving electrodes capable of applying an electric field to the piezoelectric bodies 14, are sandwiched as a pair of electrodes between the piezoelectric bodies 14 and also arranged on opposite outermost layers. Moreover, the electrode 19 is disposed on one outermost layer (an upper surface in FIG. 1(*c*)), and the electrode 18 having a different polarity is disposed on the other outermost layer (a lower surface in FIG. 1(*c*)). The electrodes 18, 19 comprise three layers of the electrodes 18 and three layers of the electrodes 19, and they are connected to an outer electrode 28 and an outer electrode 29 which are formed on side surfaces of the introduction member 13 and which have the same polarity, respectively.

As clearly shown in FIG. 1(*b*), the electrodes 18, 19 are exposed on a surface forming the introduction channel 5 of the introduction member 13, a surface forming the cavity 3 of the cavity member 11 and a surface forming the nozzle channel 4 of the nozzle member 12. When the liquid droplet discharging piezoelectric device 1 is configured as it is, it is difficult to treat an electrolytic liquid as a liquid to be discharged as the droplets, but the formation of insulating films on the surface forming the introduction channel 5, the surface forming the cavity 3 and the surface forming the nozzle channel 4 makes it possible to cope with this liquid.

The piezoelectric bodies 14 of the piezoelectric driving body 34 composing the whole liquid droplet discharging piezoelectric device 1 is polarized in a direction shown by an arrow P in FIG. 1(*b*). For example, the outer electrode 28 is connected as a positive electrode and the outer electrode 29 is connected as a negative electrode to an external power source, and the electric field is formed (the piezoelectric driving body 34 is turned on) in the same direction as that of polarization between the layered electrodes 18 and 19. Subsequently, the formation of the electric field is stopped (the piezoelectric driving body 34 is turned off). When such an operation is repeated, the piezoelectric driving body 34 (the piezoelectric bodies 14) composing the whole liquid droplet discharging piezoelectric device 1 is displaced in an arrow S1 direction based on a lateral effect of an electrically inductive strain. Moreover, for example, when an end surface of the introduction member 13 provided with the introduction port 6 is regarded as a fixed surface and the piezoelectric driving body 34 (the piezoelectric bodies 14) is turned on, the body contracts along the arrow S1 direction toward the right in the drawing. When the piezoelectric driving body 34 (the piezoelectric bodies 14) is turned off, the body elongates along the arrow S1 direction toward the left in the drawing to return to its original state.

Moreover, when the body is turned on/off as described above in the liquid droplet discharging piezoelectric device 1, the piezoelectric driving body 34 (the piezoelectric bodies 14) is displaced based on a longitudinal effect of an electrically inductive strain as well, as the lateral effect of the electrically inductive strain. If the direction (the arrow P direction) of the polarization is the same as that of the electric field, the displacement the piezoelectric driving body 34 based on the longitudinal effect of the electrically inductive strain occurs in the same direction. The liquid droplet discharging piezoelectric device 1 has a configuration in which the electrodes 18, 19 having different polarities are alternately laminated. Therefore, the direction of the electric field at a time when the body is turned on differs with each layer of the piezoelectric body 14 as shown in FIG. 1(*b*). With the change of the direction, the piezoelectric bodies 14 are polarized in the direction shown by the arrow P in FIG. 1(*b*). Therefore, when the piezoelectric driving body 34 is turned on, the layered piezoelectric bodies 14 elongate in an arrow S3 direction (a vertical direction in the drawing). When the piezoelectric driving body is turned off, the layered piezoelectric bodies contract in the arrow S3 direction (the vertical direction in the drawing). These operations generate a pressing force in the introduction channel 5, the cavity 3 and the nozzle channel 4 of the liquid droplet discharging piezoelectric device 1. When these series of operations are performed, the liquid with which the cavity 3 has been filled is discharged as the droplets from the discharge port 7 in the liquid droplet discharging piezoelectric device 1.

It is to be noted that in the liquid droplet discharging piezoelectric device 1, a surface roughness Rmax of an end surface of the nozzle member 12 on a discharge port 7 side is 1 μm or less. On the other hand, the surface roughness Rmax of the nozzle channel 4, the cavity 3 and the introduction channel 5 is 10 to 20 μm, and is larger than that of the end surface on the discharge port 7 side.

Figure 2:
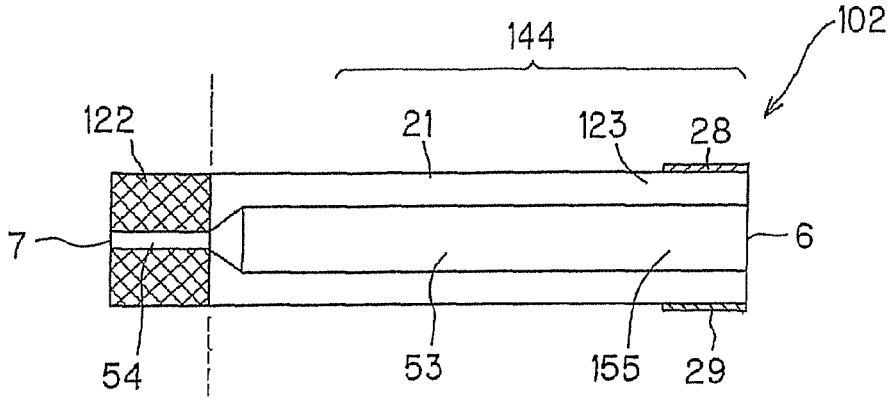
FIG. 2 is a sectional view showing another embodiment of the liquid droplet discharging piezoelectric device according to the present invention.

Next, FIG. 2 is a sectional view (a sectional view which corresponds to FIG. 1(*d*) and which does not include any inner electrode) showing another embodiment of the liquid droplet discharging piezoelectric device according to the present invention. A liquid droplet discharging piezoelectric device 102 shown in FIG. 2 includes a cavity member 21 in which a cavity 53 is built; an introduction member 123 having an introduction channel 155 which connects with the cavity 53; and a nozzle member 122 having a nozzle channel 54 which connects with the cavity 53 on a side opposite to the introduction channel 155. The introduction member 123 is provided with an introduction port 6 to introduce a liquid into the cavity 53 via the introduction channel 155. The nozzle member 122 is provided with a discharge port 7 to discharge the liquid with which the cavity 53 has been filled as droplets via the nozzle channel 54.

In the liquid droplet discharging piezoelectric device 102, sections of the cavity 53 of the cavity member 21 and the introduction channel 155 of the introduction member 123 vertical to a liquid flow direction have the same rectangular shape (not shown) that is thinner and longer than that of the liquid droplet discharging piezoelectric device 1. The sections also have an equal size, are continuously connected to one another and formed as one through hole. Therefore, boundaries among the cavity member 21 and the introduction member 123 are not clearly shown.

On the other hand, unlike the above liquid droplet discharging piezoelectric device 1, a section of the nozzle member 122 vertical to the liquid flow direction of the nozzle channel 54 is smaller than the sections of the cavity 53 and the introduction channel 155 vertical to the liquid flow direction. The cavity 53 of the cavity member 21 continuously reduces its sectional size (as in a tapered shape) on a nozzle channel 54 side of the cavity, and is smoothly connected to the nozzle channel 54 of the nozzle member 122.

Moreover, in the liquid droplet discharging piezoelectric device 102, the cavity member 21 and the introduction member 123 (a side view is not shown) are composed as a piezoelectric driving body 144 in which layered piezoelectric bodies made of a ceramic material and layered electrodes made of a conductive material are alternately laminated and integrally formed by sintering. The liquid flow direction crosses a laminating direction at right angles. In the piezoelectric driving body 144, a constitution of the electrode, polarization of the piezoelectric bodies, displacements based on lateral and longitudinal effects of an electrically inductive strain, an operation to generate a pressing force as a driving body and the like conform to those of the piezoelectric driving body 34. On the other hand, the nozzle member 122 is formed of a metal material (stainless such as SUS 304, titanium or the like) or a resin material (polyether ether ketone (PEEK), polyethylene terephthalate (PET) or the like), and composed as a non-driving portion. It is to be noted that in the liquid droplet discharging piezoelectric device according to the present invention, even in a case where the nozzle member is not composed as the piezoelectric driving body as in this configuration of the liquid droplet discharging piezoelectric device 102, when the nozzle member comprises the piezoelectric bodies in which any electrode is not formed (sandwiched) instead of the metal material or the resin material, all the constitution including the nozzle member can be integrated by sintering.

Furthermore, in the liquid droplet discharging piezoelectric device 102, a surface roughness Rmax of an end surface of the nozzle member 122 on a discharge port 7 side is 1 μm or less, and is smaller than that of the nozzle channel 54, the cavity 53 and the introduction channel 155 having a surface roughness Rmax of 10 to 20 μm in the same manner as in the liquid droplet discharging piezoelectric device 1.

Figure 3:
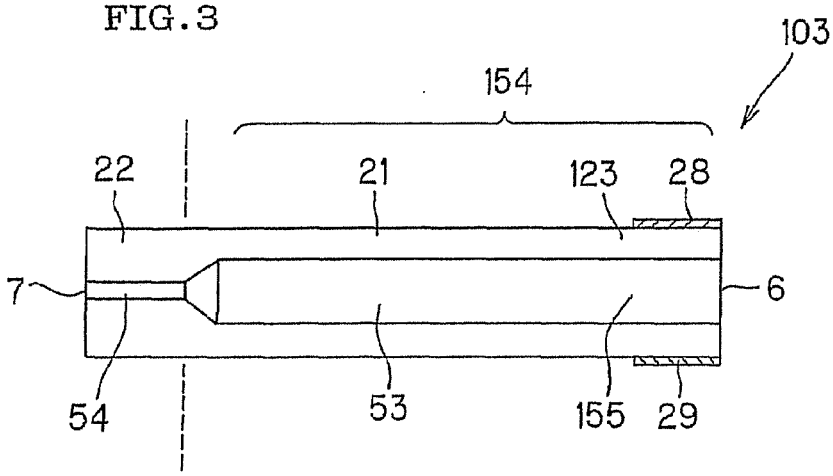
FIG. 3 is a sectional view showing still another embodiment of the liquid droplet discharging piezoelectric device according to the present invention.

Next, FIG. 3 is a sectional view (a sectional view which corresponds to FIG. 1(*d*) and which does not include any inner electrode) showing still another embodiment of the liquid droplet discharging piezoelectric device according to the present invention. A liquid droplet discharging piezoelectric device 103 shown in FIG. 3 has a configuration which conforms to that of the above liquid droplet discharging piezoelectric device 102, but is different from the liquid droplet discharging piezoelectric device 102 in that a nozzle member also comprises a piezoelectric driving body, a nozzle member, a cavity member and an introduction member are integrated by sintering and the whole constitution can be driven by a piezoelectric driving body in the same manner as in the above liquid droplet discharging piezoelectric device 1 (see FIG. 1(*d*)).

The liquid droplet discharging piezoelectric device 103 includes a cavity member 21 in which a cavity 53 is built; an introduction member 123 having an introduction channel 155 which connects with the cavity 53; and a nozzle member 22 having a nozzle channel 54 which connects with the cavity 53 on a side opposite to the introduction channel 155. The introduction member 123 is provided with an introduction port 6 to introduce a liquid into the cavity 53 via the introduction channel 155. The nozzle member 22 is provided with a discharge port 7 to discharge the liquid with which the cavity 53 has been filled as droplets via the nozzle channel 54.

In the liquid droplet discharging piezoelectric device 103, the cavity member 21, the nozzle member 22 and the introduction member 123 (a side view is not shown) are composed as a piezoelectric driving body 154 in which layered piezoelectric bodies made of a ceramic material and layered electrodes made of a conductive material are alternately laminated and integrally formed by sintering. A liquid flow direction crosses a laminating direction at right angles. In the piezoelectric driving body 154, a constitution of the electrode, polarization of the piezoelectric bodies, displacements based on lateral and longitudinal effects of an electrically inductive strain, an operation to generate a pressing force as a driving body and the like conform to those of the piezoelectric driving body 34 of the liquid droplet discharging piezoelectric device 1. A surface roughness Rmax of an end surface of the nozzle member 22 on a discharge port 7 side is smaller than a surface roughness Rmax of the nozzle channel 54, the cavity 53 and the introduction channel 155 in the same manner as in the liquid droplet discharging piezoelectric device 102.

Figure 4A:
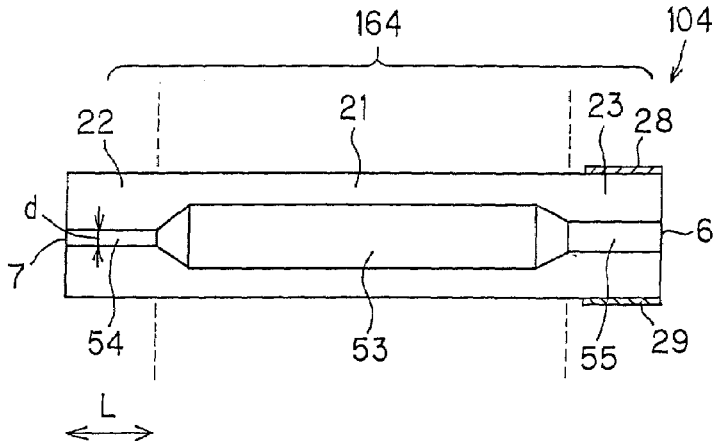
FIG. 4 is a diagram showing a further embodiment of the liquid droplet discharging piezoelectric device according to the present invention, (a) is a sectional view in a longitudinal direction and (b) is a side view in a short direction.
Figure 4B:
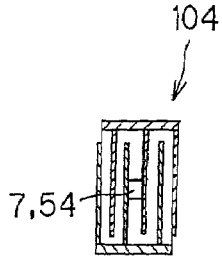

Next, FIG. 4 is diagram showing a further embodiment of the liquid droplet discharging piezoelectric device according to the present invention, FIG. 4(*a*) is a sectional view (a sectional view which corresponds to FIG. 1(*d*) and which does not include any inner electrode) in a longitudinal direction, and FIG. 4(*b*) is a side view (a left side view of FIG. 4(*a*)) in a short direction. A liquid droplet discharging piezoelectric device 104 shown in FIGS. 4(*a*), (*b*) includes a cavity member 21 in which a cavity 53 is built; an introduction member 23 having an introduction channel 55 which connects with the cavity 53; and a nozzle member 22 having a nozzle channel 54 which connects with the cavity 53 on a side opposite to the introduction channel 55. The introduction member 23 is provided with an introduction port 6 to introduce a liquid into the cavity 53 via the introduction channel 55. The nozzle member 22 is provided with a discharge port 7 to discharge the liquid with which the cavity 53 has been filled as droplets via the nozzle channel 54.

In the liquid droplet discharging piezoelectric device 104, the cavity member 21 and the cavity 53, and the nozzle member 22 and the nozzle channel 54 have substantially the same configurations as those of the liquid droplet discharging piezoelectric device 103. In the nozzle member 22, a section of the nozzle channel 54 vertical to a liquid flow direction is smaller than a section of the cavity 53 vertical to the liquid flow direction. The cavity 53 of the cavity member 21 continuously reduces its sectional size (as in a tapered shape) on a nozzle channel 54 side of the cavity, and is smoothly connected to the nozzle channel 54 of the nozzle member 22.

In the liquid droplet discharging piezoelectric device 104, the section of the nozzle channel 54 of the nozzle member 22 vertical to the liquid flow direction has a rectangular shape (see FIG. 4(*b*)). It is to be noted that this sectional shape may be square or trapezoidal, and is appropriately set in accordance with the liquid. In the liquid droplet discharging piezoelectric device 104, a ratio d/L between the shortest distance d in the section of the nozzle channel 54 of the nozzle member 22 and a length L of the nozzle channel is 0.2. Without limiting to a liquid droplet discharging piezoelectric device having a configuration such as that of this liquid droplet discharging piezoelectric device 104, for example, in a case where the liquid droplet discharging piezoelectric device according to the present invention is used as a discharge device of a micro liquid droplet discharge apparatus for use in a manufacturing process of a DNA chip necessary for analysis of a genetic structure, it is preferable that the shortest distance d is set to 0.05 to 0.1 mm, the length L is set to 0.1 to 1 mm and d/L is set to 0.08 to 0.8 in order to secure stability of a discharge amount.

On the other hand, unlike the above liquid droplet discharging piezoelectric device 103, in the introduction member 23, the section of the introduction channel 55 vertical to the liquid flow direction is smaller than the section of the cavity 53 vertical to the liquid flow direction. The cavity 53 of the cavity member 21 continuously reduces its sectional size (as in a tapered shape) on an introduction channel 55 side of the cavity, and is smoothly connected to the introduction channel 55 of the introduction member 23. That is, the nozzle member 22 and the introduction member 23 are formed so as to be substantially symmetric centering on the cavity member 21. It is to be noted that the section of the introduction channel 55 vertical to the liquid flow direction is slightly larger than that of the nozzle channel 54 vertical to the liquid flow direction.

In the liquid droplet discharging piezoelectric device 104, the cavity member 21, the nozzle member 22 and the introduction member 23 (a side view is not shown) are composed as a piezoelectric driving body 164 in which layered piezoelectric bodies made of a ceramic material and layered electrodes made of a conductive material are alternately laminated and integrally formed by sintering in the same manner as in the above liquid droplet discharging piezoelectric devices 1, 103. The liquid flow direction crosses a laminating direction at right angles. In the piezoelectric driving body 164, a constitution of the electrode, polarization of the piezoelectric bodies, displacements based on lateral and longitudinal effects of an electrically inductive strain, an operation to generate a pressing force as a driving body and the like conform to those of the piezoelectric driving body 34 of the liquid droplet discharging piezoelectric device 1.

Figure 5A:
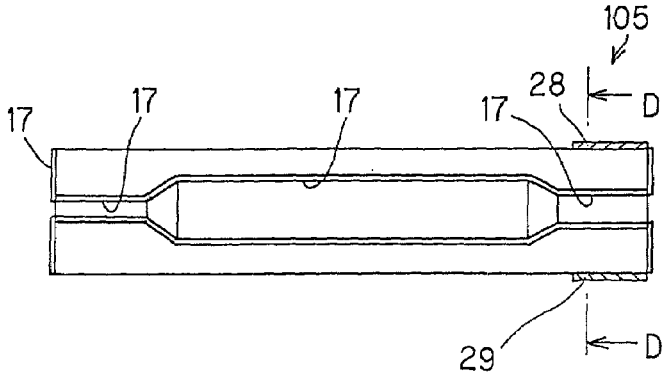
FIG. 5 is a diagram showing a further embodiment of the liquid droplet discharging piezoelectric device according to the present invention, (a) is a sectional view in a longitudinal direction and (b) is a sectional view showing the DD section in (a) in a short direction.
Figure 5B:
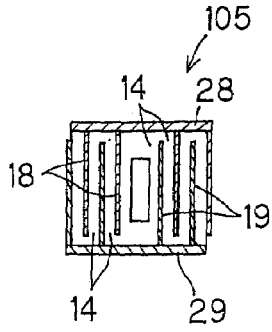

Next, FIG. 5 is a diagram showing a further embodiment of the liquid droplet discharging piezoelectric device according to the present invention, FIG. 5(*a*) is a sectional view (a sectional view which corresponds to FIG. 1(*d*) and which does not include any inner electrode) in a longitudinal direction, and FIG. 5(*b*) is a sectional view showing the DD section in FIG. 5(*a*) in a short direction. A liquid droplet discharging piezoelectric device 105 shown in FIGS. 5(*a*), (*b*) is a liquid droplet discharging piezoelectric device having substantially the same configuration as that of the above liquid droplet discharging piezoelectric device 104. However, the device is different from the liquid droplet discharging piezoelectric device 104 only in that an end surface of an introduction member on an introduction port side, a surface forming introduction channel of the introduction member, surface forming cavity of a cavity member, a surface forming nozzle channel of a nozzle member and an end surface of the nozzle member on a discharge port side shown as insulating portions 17 in FIG. 5(*a*), electrodes (electrodes 18, 19, outer electrodes 28, 29) are buried in piezoelectric bodies (piezoelectric bodies 14) and are not exposed. This is understood when referring to the insulating portions 17 of the liquid droplet discharging piezoelectric device 105 shown in FIG. 5(*a*) in comparison with to FIG. 4(*a*).

The configuration of the liquid droplet discharging piezoelectric device 105 can treat an electrolytic liquid as a liquid to be discharged as droplets. It is to be noted that insulation can be achieved, for example, when a film is separately formed of the same material as that of the piezoelectric body. For the sake of convenience, portions on which any electrode is not exposed are shown by the insulating portions 17 in FIG. 5(*a*), and they are not portions on which any new film or the like is not formed. The liquid droplet discharging piezoelectric device 105 is the same liquid droplet discharging piezoelectric device as the liquid droplet discharging piezoelectric device 104 except that the electrodes are not exposed, and description of the whole constitution or the like is omitted.

Figure 6:
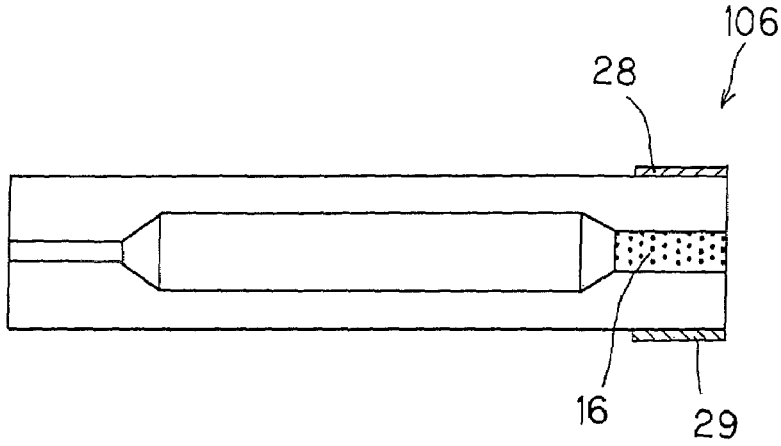
FIG. 6 is a sectional view showing a further embodiment of the liquid droplet discharging piezoelectric device according to the present invention.

Next, FIG. 6 is a sectional view (a sectional view which corresponds to FIG. 1(*d*) and which does not include any inner electrode) showing a further embodiment of the liquid droplet discharging piezoelectric device according to the present invention. A liquid droplet discharging piezoelectric device 106 shown in FIG. 6 has substantially the same configuration as that of the above liquid droplet discharging piezoelectric device 104, but is different in that an introduction channel (see FIG. 4(*a*)) of an introduction member comprises a porous body 16 having a gas liquid separating function. It is to be noted that the porous body 16 is a porous body made of polypropylene. The liquid droplet discharging piezoelectric device 106 is the same liquid droplet discharging piezoelectric device as the liquid droplet discharging piezoelectric device 104 in the other respects, and description of the whole constitution or the like is omitted.

Figure 7:
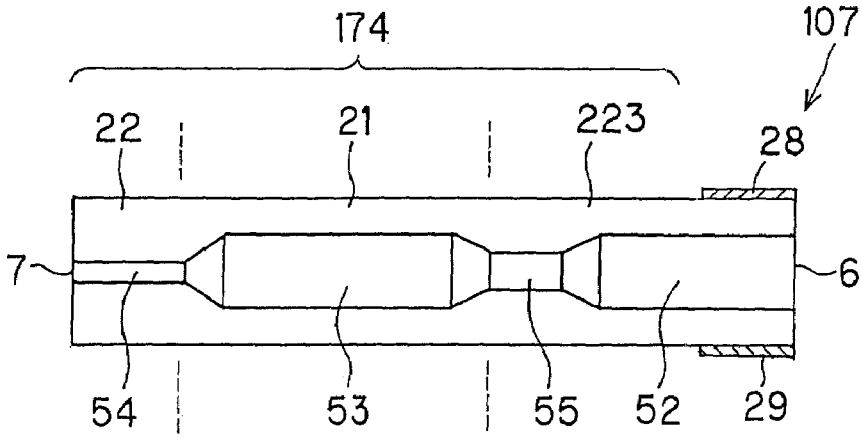
FIG. 7 is a sectional view showing a further embodiment of the liquid droplet discharging piezoelectric device according to the present invention.

Next, FIG. 7 is a sectional view (a sectional view which corresponds to FIG. 1(*d*) and which does not include any inner electrode) showing a further embodiment of the liquid droplet discharging piezoelectric device according to the present invention. A liquid droplet discharging piezoelectric device 107 shown in FIG. 7 is different from the liquid droplet discharging piezoelectric device described above in that on an introduction port side of an introduction channel, an introduction member includes an introduction cavity which connects with the introduction channel and whose section vertical to a liquid flow direction is larger than that of the introduction channel.

The liquid droplet discharging piezoelectric device 107 includes a cavity member 21 in which a cavity 53 is built; a nozzle member 22 having a nozzle channel 54 which connects with the cavity 53; and an introduction member 223. The introduction member 223 has an introduction channel 55 which connects with the cavity 53 on a side opposite to the nozzle channel 54. Furthermore, on an introduction port 6 side of the member, the member has an introduction cavity 52 which connects with the introduction channel 55 and whose section vertical to the liquid flow direction is larger than that of the introduction channel 55, and has a size substantially equal to that of the cavity 53. In the introduction member 223, a liquid is introduced into the cavity 53 via the introduction cavity 52 and the introduction channel 55, and a larger amount of the liquid can smoothly be introduced into the cavity 53. It is to be noted that it is preferable to further dispose a channel equivalent to the introduction channel 55 on an introduction port 6 side of the introduction cavity 52. This is because a sealing area of the channel can be increased in a case where the liquid droplet discharging piezoelectric device is attached to an application apparatus.

In the liquid droplet discharging piezoelectric device 107, a section of the introduction channel 55 of the introduction member 223 vertical to the liquid flow direction is smaller than a section of the cavity 53 of the cavity member 21 vertical to the liquid flow direction. The cavity 53 continuously reduces its sectional size (as in a tapered shape) on an introduction channel 55 side of the cavity, and is smoothly connected to the introduction channel 55. Moreover, in the introduction member 223, a section of the introduction channel 55 vertical to the liquid flow direction is smaller than a section of the introduction cavity 52 vertical to the liquid flow direction. The introduction cavity 52 continuously reduces its sectional size (as in a tapered shape) on the introduction channel 55 side of the cavity, and is smoothly connected to the introduction channel 55. On the other hand, the nozzle member 22 is provided with a discharge port 7, and the liquid with which the cavity 53 has been filled is discharged as droplets via the nozzle channel 54.

In the liquid droplet discharging piezoelectric device 107, the cavity member 21, the nozzle member 22 and the introduction member 223 (a side view is not shown) are composed as a piezoelectric driving body 174 in which layered piezoelectric bodies made of a ceramic material and layered electrodes made of a conductive material are alternately laminated and integrally formed by sintering. The liquid flow direction crosses a laminating direction at right angles. In the piezoelectric driving body 174, a constitution of the electrode, polarization of the piezoelectric bodies, displacements based on lateral and longitudinal effects of an electrically inductive strain, an operation to generate a pressing force as a driving body and the like conform to those of the piezoelectric driving body 34 of the liquid droplet discharging piezoelectric device 1.

Figure 8A:
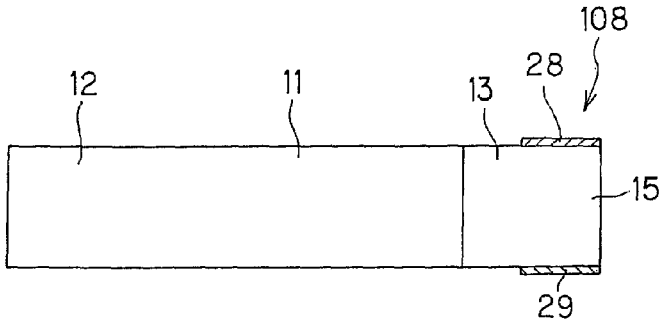
FIG. 8 is a diagram showing a further embodiment of the liquid droplet discharging piezoelectric device according to the present invention, (a) is a plan view, (b) is a side view in a short direction (a right side view of (a)) and (c) is a side view in a longitudinal direction (a lower side view of (a))
Figure 8B:
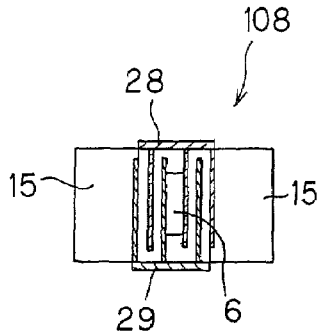
Figure 8C:
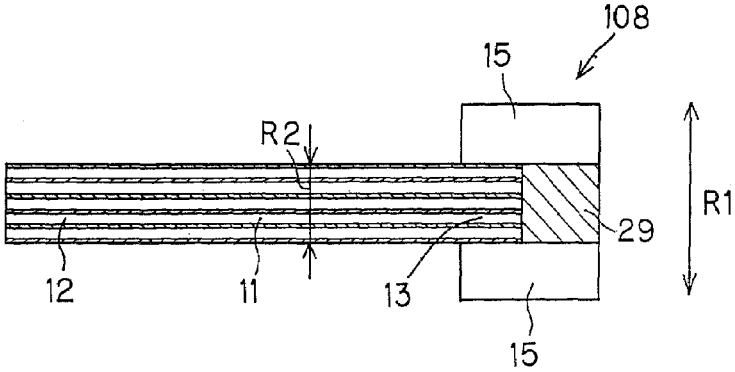

Next, FIG. 8 is a diagram showing a further embodiment of the liquid droplet discharging piezoelectric device according to the present invention, FIG. 8(*a*) is a plan view, FIG. 8(*b*) is a side view in a short direction (a right side view of FIG. 8(*a*)) and FIG. 8(*c*) is a side view in a longitudinal direction (a lower side view of FIG. 8(*a*)). A liquid droplet discharging piezoelectric device 108 shown in FIGS. 8(*a*) to (*c*) is a liquid droplet discharging piezoelectric device having substantially the same configuration as that of the above liquid droplet discharging piezoelectric device 1. However, the device is different from the liquid droplet discharging piezoelectric device 1 in that an introduction member 13 is provided with flange portions 15 for attaching the liquid droplet discharging piezoelectric device to an apparatus to which a liquid droplet discharging piezoelectric device such as a micro liquid droplet discharge device is to be applied, a length R1 of an end surface of at least the introduction member 13 on an introduction port 6 side is longer than a length R2 along a laminating direction of a section of a cavity member 11 vertical to a liquid flow direction, and therefore the end surface of at least the introduction member 13 on the introduction port 6 side is larger than the section of the cavity member 11 vertical to the liquid flow direction. The liquid droplet discharging piezoelectric device 108 is the same liquid droplet discharging piezoelectric device as that of the liquid droplet discharging piezoelectric device 1 in the other respects, and description of the whole constitution or the like is omitted.

Figure 9A:
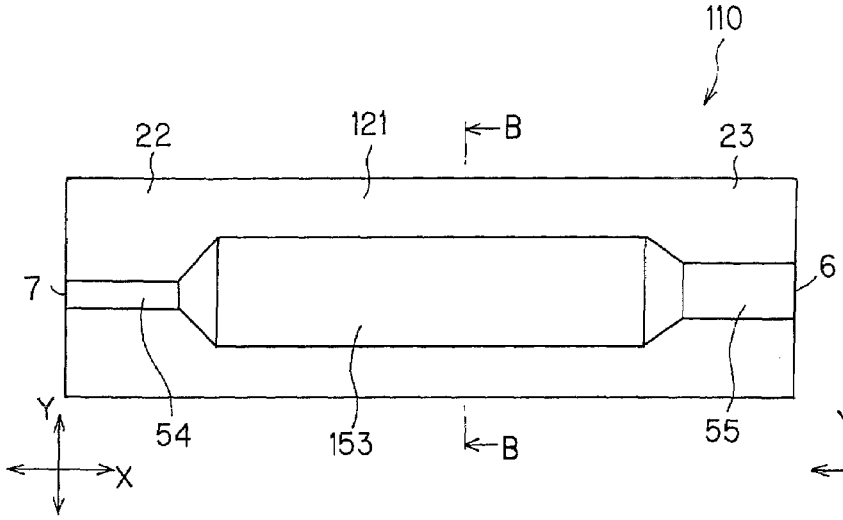
FIG. 9 is a diagram showing a further embodiment of the liquid droplet discharging piezoelectric device according to the present invention, (a) is a sectional view in a longitudinal direction and (b) is a sectional view showing the BB section in (a)
Figure 9B:
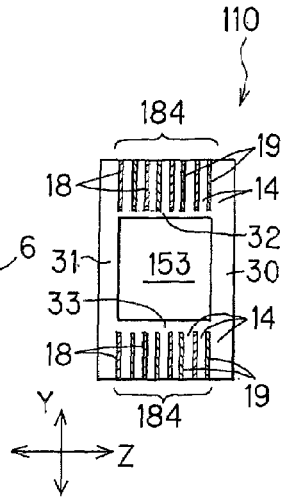
Figure 9C:
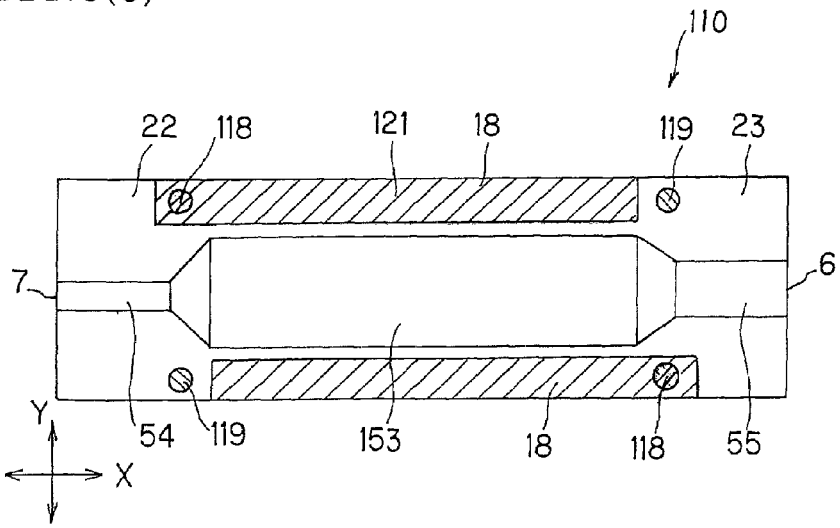
Figure 10A:
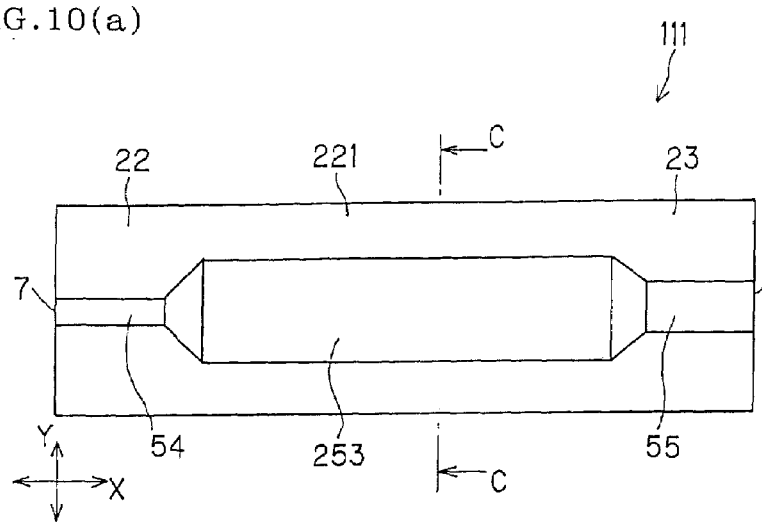
FIG. 10 is a diagram showing a further embodiment of the liquid droplet discharging piezoelectric device according to the present invention, (a) is a sectional view in a longitudinal direction and (b) is a sectional view showing the CC section in (a)
Figure 10B:
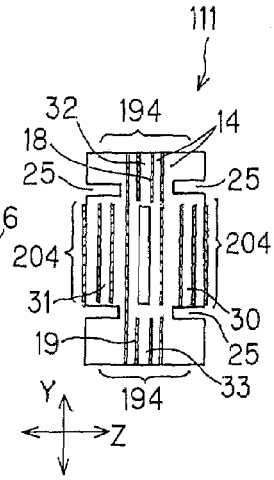
Figure 10C:
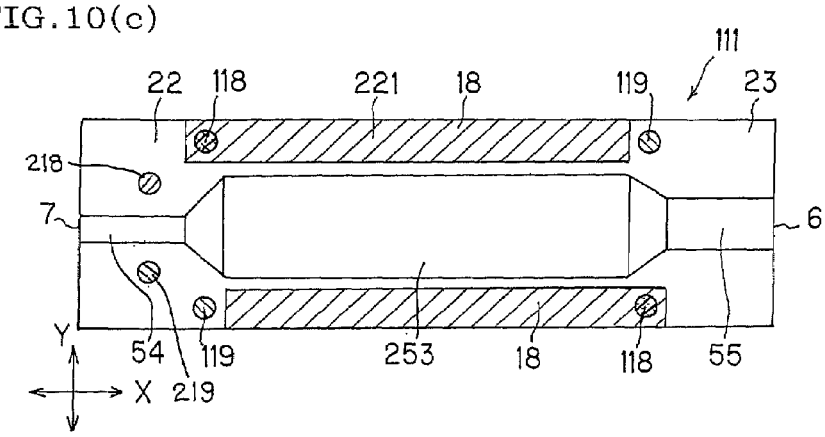
Figure 10D:
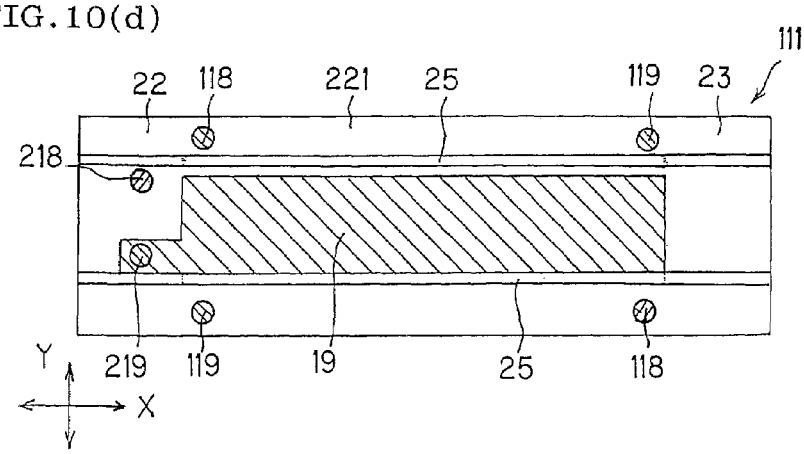

Next, FIG. 9 is a diagram showing a further embodiment of the liquid droplet discharging piezoelectric device according to the present invention, FIG. 9(*a*) is a sectional view (a sectional view which corresponds to FIG. 1(*d*) and which does not include any inner electrode) in a longitudinal direction, FIG. 9(*b*) is a sectional view showing a section (the BB section in FIG. 9(*a*)) of a cavity member portion in a short direction, and FIG. 9(*c*) is a sectional view including the inner electrode in a longitudinal direction. A liquid droplet discharging piezoelectric device 110 shown in FIGS. 9(*a*) to (*c*) is a liquid droplet discharging piezoelectric device having substantially the same configuration as that of the above liquid droplet discharging piezoelectric device 104. However, the device is different from the liquid droplet discharging piezoelectric device 104 or the like in that unlike the liquid droplet discharging piezoelectric device 104, the liquid droplet discharging piezoelectric device 1 or the like, the whole device is not composed as a piezoelectric driving body, a cavity member has a prismatic shape, a cavity is defined by two sets of opposite wall portions, and one set of opposite wall portions comprises the piezoelectric driving bodies, but the other set of wall portions comprises piezoelectric bodies only.

The liquid droplet discharging piezoelectric device 110 includes a cavity member 121 in which a cavity 153 is built; an introduction member 23 having an introduction channel 55 which connects with the cavity 153; and a nozzle member 22 having a nozzle channel 54 which connects with the cavity 153 on a side opposite to the introduction channel 55. The cavity member 121 has a prismatic shape, and the cavity 153 having a rectangular sectional shape is formed by wall portions 30, 31 and wall portions 32, 33 which face each other. The introduction member 23 is provided with an introduction port 6 to introduce a liquid into the cavity 153 via the introduction channel 55. The nozzle member 22 is provided with a discharge port 7 to discharge the liquid with which the cavity 153 has been filled as droplets via the nozzle channel 54.

In the liquid droplet discharging piezoelectric device 110, the cavity member 121, the introduction member 23 and the nozzle member 22 are all composed by laminating nine layers of piezoelectric bodies 14 made of a ceramic material, and integrally formed by sintering. A liquid flow direction crosses a laminating direction at right angles. However, unlike the liquid droplet discharging piezoelectric device 104, the liquid droplet discharging piezoelectric device 1 or the like, eight layers of electrodes 18, 19 in total, made of a conductive material, are not always laminated among all the piezoelectric bodies 14, and are not always present at the opposite wall portions 30, 31.

The electrodes 18, 19 are driving electrodes capable of applying an electric field to the piezoelectric bodies 14 as a pair of electrodes, are wall portions 32, 33 and laminated on positions corresponding to the cavity 153, and comprise piezoelectric driving bodies 184 together with the piezoelectric bodies 14. The electrodes 18, 19 comprise four layers of the electrodes 18 and four layers of the electrodes 19. The four layers of the electrodes 18 conduct via via-holes 118 extending through the piezoelectric bodies 14, and four layers of the electrodes 19 conduct via via-holes 119 extending through the piezoelectric bodies 14 (see FIG. 9(*c*)). The electrodes 18, 19 are not exposed on a surface which forms the cavity 153 (see FIG. 9(*b*)).

In the liquid droplet discharging piezoelectric device 110, the piezoelectric bodies 14 comprising the piezoelectric driving bodies 184 present at the wall portions 32, 33 are polarized in, for example, directions from the electrodes 18 to the electrodes 19 (a polarized direction differs with each layer in accordance with the sandwiched electrode). Moreover, a power source is connected to a terminal electrode (not shown), and a driving electric field is applied between the electrodes 18 and 19 via the terminal electrode while an electrode 18 side is regarded as a positive electrode and an electrode 19 side is regarded as a negative electrode. In consequence, the electric field having the same direction as the polarized direction described above is formed. That is, the layered piezoelectric bodies 14 having mutually opposite polarized directions are laminated while the electrodes 18, 19 are sandwiched between the piezoelectric bodies. In each piezoelectric body 14, the polarization has the same direction as that of the driving electric field. As a result, an electrically inductive strain is developed in the piezoelectric body 14, and the piezoelectric driving bodies 184 expand or contract substantially in an X-direction in FIG. 9(*a*) based on displacements due to lateral effects of the bodies, and expand or contract substantially in a Z-direction in FIG. 9(*b*) based on displacements due to longitudinal effects of the bodies.

In the liquid droplet discharging piezoelectric device 110, since the displacements of these piezoelectric bodies 14 directly use the electrically inductive strain, a large force is generated, and a high response speed is achieved. The individual layers do not develop large displacement amounts. However, since there are seven layers of the piezoelectric bodies 14 sandwiched between the electrodes 18 and 19, the displacement amount is obtained in proportion to the number of the layers, and a large displacement can be obtained.

According to such a configuration, in the liquid droplet discharging piezoelectric device 110, the only wall portions 32, 33 are displaced in the cavity member 121. Moreover, especially the displacement based on the longitudinal effect increases a pressure in the cavity 153, and generates a pressing force in the cavity 153, and the liquid with which the cavity 153 is filled is discharged as droplets from the discharge port 7 by the pressing force of the cavity.

Figure 11:
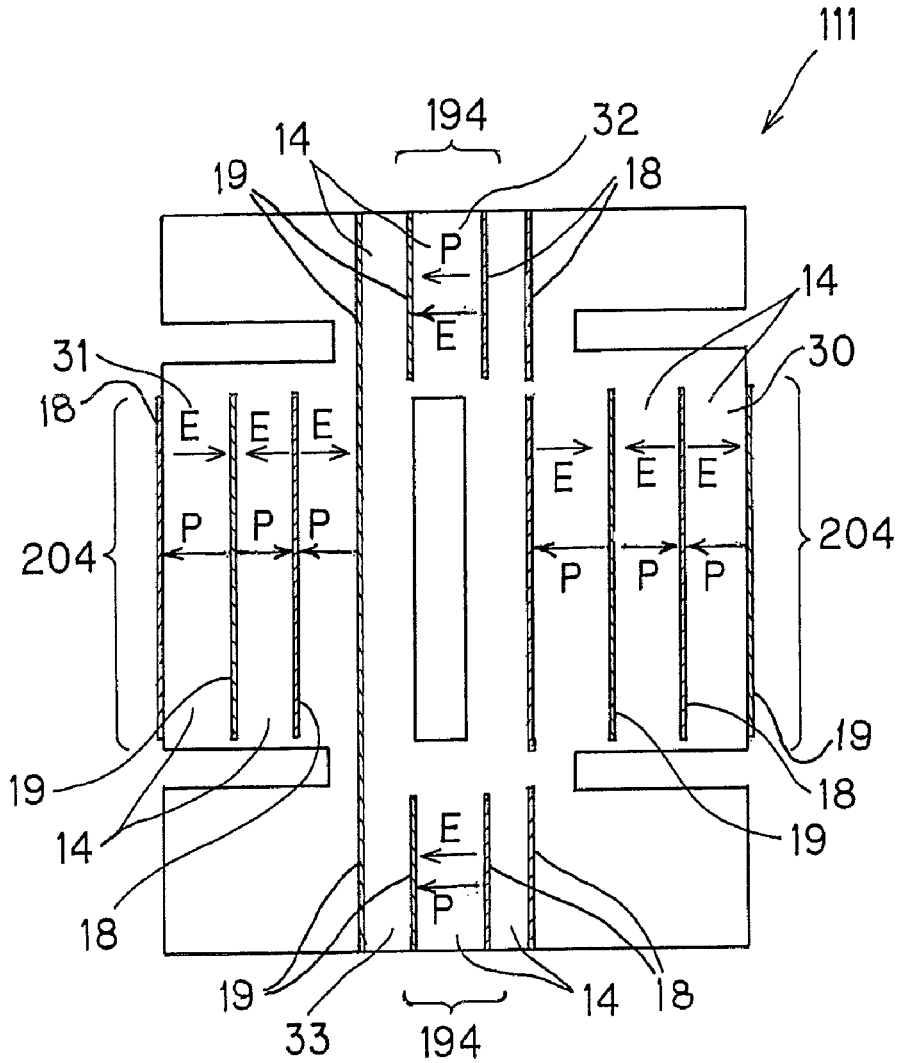
FIG. 11 is an enlarged view of FIG. 10(*b*), showing a relation between a polarized direction and a driving electric field direction.

Next, FIGS. 10 and 11 are diagrams showing a further embodiment of the liquid droplet discharging piezoelectric device according to the present invention, FIG. 10(*a*) is a sectional view (a sectional view which corresponds to FIG. 1(*d*) and which does not include any inner electrode) in a longitudinal direction, and FIG. 10(*b*) is a sectional view showing a section (the CC section in FIG. 10(*a*)) of a cavity member portion in a short direction. FIG. 10(*c*) is a sectional view showing a section of one piezoelectric driving body (piezoelectric driving bodies 194) including inner electrodes and a cavity in a longitudinal direction. FIG. 10(*d*) is a sectional view showing a section of the other piezoelectric driving body (piezoelectric driving bodies 204) including an inner electrode and slits in a longitudinal direction. FIG. 11 is an enlarged view of FIG. 10(*b*), showing a relation between a polarized direction and a driving electric field direction. A liquid droplet discharging piezoelectric device 111 shown in FIGS. 10(*a*) to (*d*) and FIG. 11 is a liquid droplet discharging piezoelectric device having substantially the same configuration as that of the above liquid droplet discharging piezoelectric device 110. However, the device is different from the liquid droplet discharging piezoelectric device 110 in that two sets of opposite wall portions both comprise piezoelectric driving bodies in a cavity member having a prismatic shape formed of two sets of opposite wall portions. In two sets of opposite wall portions both comprising the piezoelectric driving bodies, polarized directions of piezoelectric bodies of the piezoelectric driving bodies composing one set of opposite wall portions is different from those of the piezoelectric bodies of the piezoelectric driving bodies composing the other set of opposite wall portions in a relation between the polarized direction and the driving electric field.

The liquid droplet discharging piezoelectric device 111 includes a cavity member 221 in which a cavity 253 is built; an introduction member 23 having an introduction channel 55 which connects with the cavity 253; and a nozzle member 22 having a nozzle channel 54 which connects with the cavity 253 on a side opposite to the introduction channel 55. The cavity member 221 has a prismatic shape, and the cavity 253 having a rectangular sectional shape is formed by wall portions 30, 31 and wall portions 32, 33 which face each other. The introduction member 23 is provided with an introduction port 6 to introduce a liquid into the cavity 253 via the introduction channel 55. The nozzle member 22 is provided with a discharge port 7 to discharge the liquid with which the cavity 253 has been filled as droplets via the nozzle channel 54.

In the liquid droplet discharging piezoelectric device 111, the cavity member 221, the introduction member 23 and the nozzle member 22 are all composed by laminating nine layers of piezoelectric bodies 14 made of a ceramic material, and integrally formed by sintering. A liquid flow direction crosses a laminating direction at right angles. However, unlike the liquid droplet discharging piezoelectric device 104, the liquid droplet discharging piezoelectric device 1 or the like, ten layers of electrodes 18, 19 made of a conductive material are not always laminated among all the piezoelectric bodies 14. On the other hand, unlike the liquid droplet discharging piezoelectric device 110, the electrodes 18, 19 are present at all of the opposite wall portions 30, 31 and the opposite wall portions 32, 33.

The electrodes 18, 19 are driving electrodes capable of applying an electric field to the piezoelectric bodies 14 as a pair of electrodes, and are all the wall portions 30, 31, 32 and 33 forming the cavity 253 and laminated on positions corresponding to the cavity 253. Moreover, the electrodes 18, 19 are comprised in piezoelectric driving bodies 194 together with the piezoelectric bodies 14 in the wall portions 32, 33, and they also are comprised in the piezoelectric driving bodies 204 together with the piezoelectric bodies 14 in the opposite wall portions 30, 31. However, the electrodes are not present at corner portions of a prismatic body distant from the cavity 253 (see FIGS. 10(*b*) and 11).

The electrodes 18, 19 being comprised in the piezoelectric driving bodies 194, 204 comprise five layers of the electrodes 18 and five layers of the electrodes 19 in total. As shown in FIGS. 10(*c*), (*d*), in these electrodes 18, 19, wiring lines are extended to side of an introduction member 23 or a nozzle member 22 side, and conduct via via-holes 118, 119, 218 and 219 extending through the piezoelectric bodies 14 for each polarity. The electrodes 18 of the piezoelectric driving bodies 194 conduct via the via-holes 118 extending through the piezoelectric body 14, and the electrodes 19 of the piezoelectric driving bodies 194 conduct via the via-holes 119 extending through the piezoelectric bodies 14 (see FIG. 10(*c*)). The electrodes 18 of the piezoelectric driving bodies 204 conduct via the via-holes 218 extending through the piezoelectric bodies 14, and the electrodes 19 of the piezoelectric driving bodies 204 conduct via the via-holes 219 extending through the piezoelectric bodies 14 (see FIG. 10(*d*)). It is to be noted that the electrodes 18, 19 are not exposed on a surface which forms the cavity 253 (see FIGS. 10(*b*) and 11).

In the liquid droplet discharging piezoelectric device 111, the piezoelectric bodies 14 comprising the piezoelectric driving bodies 194 present at the wall portions 32, 33 are polarized in, for example, directions from the electrodes 18 to the electrodes 19 (a polarized direction differs with each layer in accordance with the sandwiched electrode). Moreover, a power source is connected to a terminal electrode (not shown), and a driving electric field is applied between the electrodes 18 and 19 via the terminal electrode while an electrode 18 side is regarded as a positive electrode and an electrode 19 side is regarded as a negative electrode. In consequence, the electric field having the same direction as the polarized direction described above is formed. That is, the layered piezoelectric bodies 14 having mutually opposite polarized directions are laminated while the electrodes 18, 19 are sandwiched between the piezoelectric bodies. In each piezoelectric body 14, the polarization has the same direction as that of the driving electric field. As a result, an electrically inductive strain is developed in the piezoelectric body 14, and the piezoelectric driving bodies 194 expand or contract substantially in a Z-direction in FIG. 10(*b*) based on displacements due to longitudinal effects of the bodies.

On the other hand, the piezoelectric bodies 14 comprising the piezoelectric driving bodies 204 present at the wall portions 30, 31 are polarized in, for example, directions from the electrodes 19 to the electrodes 18, the directions being opposite to those of the piezoelectric bodies 14 comprising the piezoelectric driving bodies 194. Moreover, the power source is connected to a terminal electrode (not shown), and a driving electric field is applied between the electrodes 18 and 19 via the terminal electrode while the electrode 18 side is regarded as the positive electrode and the electrode 19 side is regarded as the negative electrode. In consequence, the electric field having a polarized direction opposite to the above polarized direction is formed. That is, the piezoelectric bodies 14 comprising the piezoelectric driving bodies 204 have a polarized direction opposite to a driving electric field direction, the electrically inductive strain is developed in the piezoelectric body 14, and the piezoelectric driving bodies 204 expand or contract substantially in a Y-direction in FIG. 10(*b*) based on displacements due to lateral effects of the bodies. In this case, a flexural displacement is generated in the piezoelectric body 14 adjacent to the cavity 253 by the lateral effect of the piezoelectric driving body 204, and converted into a displacement in the Z-direction. Here, the polarized direction of the piezoelectric driving body 194 is set to be opposite to that of the piezoelectric driving body 204. Therefore, in a case where the same electric field is applied, since two sets of the wall portions comprising the piezoelectric driving bodies 194 and the wall portions comprising the piezoelectric driving bodies 204 have the same deformation direction, a method of driving is facilitated. Moreover, a change of volume of the cavity can be increased with a small driving voltage.

Since the above displacements of the piezoelectric bodies 14 directly use the electrically inductive strain, a large force is generated, and a high response speed is achieved. Moreover, since slits 25 are formed in the wall portions 30, 31 on opposite sides of each piezoelectric driving body 204, a large displacement close to a bulk state can be generated without restraining the piezoelectric driving bodies 194 and the piezoelectric driving bodies 204.

According to such a configuration, in the liquid droplet discharging piezoelectric device 111, all the wall portions 30, 31, 32 and 33 are displaced in the cavity member 221. Moreover, especially the displacement based on the longitudinal effect increases a pressure in the cavity 253, and generates a pressing force in the cavity 253. Moreover, the liquid with which the cavity 253 is filled is discharged as droplets from the discharge port 7 by the pressing force of the cavity.

Figure 12:
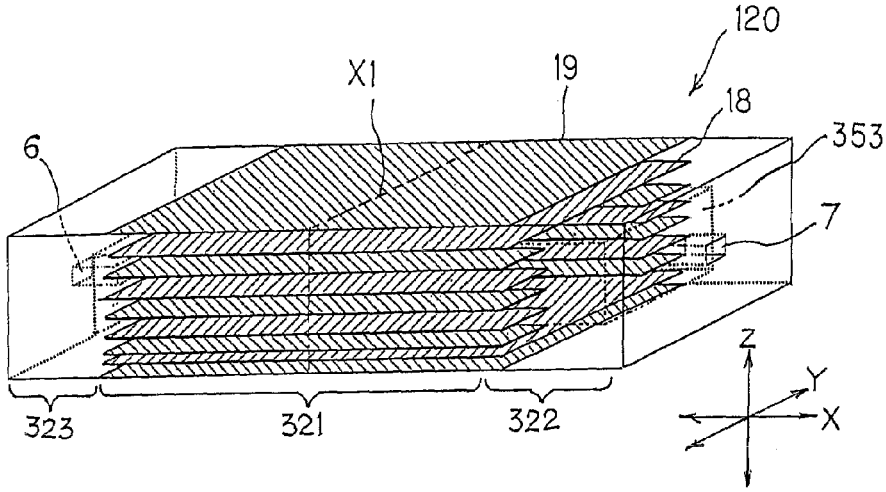
FIG. 12 is a diagram showing a further embodiment of the liquid droplet discharging piezoelectric device according to the present invention, and is a perspective view showing the inside.
Figure 13A:
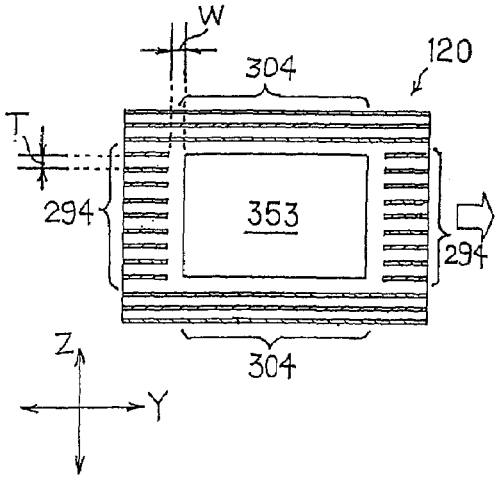
FIG. 13 is a sectional view showing a section cut along the X1 line of FIG. 12, (a) shows a state in which any electric field is not formed between a positive electrode and a negative electrode (a piezoelectric driving body is turned OFF) and (b) shows a state in which the electric field is formed between the positive electrode and the negative electrode (the piezoelectric driving body is turned ON)
Figure 13B:
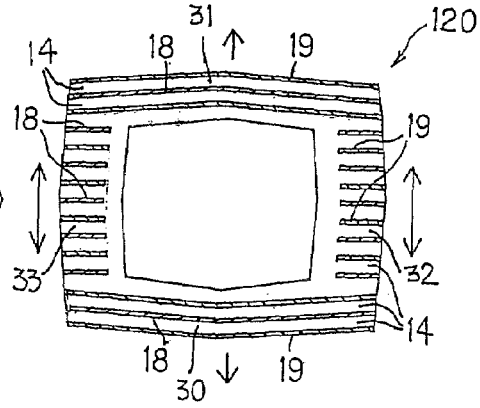

Next, FIGS. 12 and 13 are diagrams showing a further embodiment of the liquid droplet discharging piezoelectric device according to the present invention. FIG. 12 is a perspective view showing the inside. FIGS. 13(*a*), (*b*) are sectional views showing a section cut along the X1 line of FIG. 12. FIG. 13(*a*) shows a state in which any electric field is not formed between a positive electrode and a negative electrode (a piezoelectric driving body is turned OFF), and FIG. 13(*b*) shows a state in which the electric field is formed between the positive electrode and the negative electrode (the piezoelectric driving body is turned ON). It is to be noted that in FIG. 12, to facilitate understanding of the drawings, a part of electrodes are omitted.

In a liquid droplet discharging piezoelectric device 120 shown in FIGS. 12 and 13, in a cavity member having a prismatic shape formed of two sets of opposite wall portions, two sets of opposite wall portions both comprise piezoelectric driving bodies. The device is a liquid droplet discharging piezoelectric device having substantially the same configuration as that of the above liquid droplet discharging piezoelectric device 111, but is different in that any slit is not formed, and electrodes are laminated between layered piezoelectric bodies in corner portions (four corner portions) of the cavity member having the prismatic shape.

The liquid droplet discharging piezoelectric device 120 includes a cavity member 321 in which a cavity 353 is built; an introduction member 323 having an introduction channel which connects with the cavity 353; and a nozzle member 322 having a nozzle channel which connects with the cavity 353 on a side opposite to the introduction channel. The cavity member 321 has a prismatic shape, and the cavity 353 having a rectangular sectional shape is formed by wall portions 30, 31 and wall portions 32, 33 which face each other. The introduction member 323 is provided with an introduction port 6 to introduce a liquid into the cavity 353 via the introduction channel. The nozzle member 322 is provided with a discharge port 7 to discharge the liquid with which the cavity 353 has been filled as droplets via the nozzle channel.

In the liquid droplet discharging piezoelectric device 120, the cavity member 321, the introduction member 323 and the nozzle member 322 are all composed by laminating 14 layers of piezoelectric bodies 14 made of a ceramic material, and integrally formed by sintering. A liquid flow direction crosses a laminating direction at right angles. Moreover, 15 layers of electrodes 18, 19 made of a conductive material in total are laminated among the piezoelectric bodies 14 in the only cavity member 321, and are present at all of the opposite wall portions 30, 31 and the opposite wall portions 32, 33.

The electrodes 18, 19 are driving electrodes capable of applying an electric field to the piezoelectric bodies 14 as a pair of electrodes, are laminated on all the wall portions 30, 31, 32 and 33 forming the cavity 353, and are also present at corner portions of the cavity member 321. Moreover, the electrodes 18, 19 are comprised in piezoelectric driving bodies 294 together with the piezoelectric bodies 14 in the wall portions 32, 33, and they are comprised in piezoelectric driving bodies 304 together with the piezoelectric bodies 14 in the wall portions 30, 31.

In the liquid droplet discharging piezoelectric device 120, two sets of the wall portions 30, 31 and the wall portions 32, 33 which face each other both comprise piezoelectric driving bodies. In the wall portions 30, 31 where an interface between the laminated layers does not appear at the cavity 353, the electrodes 18, 19 are not exposed on a surface which forms the cavity 353. Furthermore, even in the wall portions 32, 33 where the interface between the laminated layers appears at the cavity 353, the electrodes 18, 19 are not exposed on the surface which forms the cavity 353 (see FIGS. 13(*a*), (*b*)). In the wall portions 32, 33, the layered electrodes 18, 19 stand back from the surface which forms the cavity 353, and the surfaces of the wall portions 32, 33 forming the cavity 353 comprise the piezoelectric bodies 14 only. Moreover, a distance W (a standing back distance, see FIG. 13(*a*)) from the surface which forms the cavity 353 to the electrodes 18, 19 and a thickness T (see FIG. 13(*a*)) of one layer of the piezoelectric body 14 substantially have a ratio of 1:1.

The electrodes 18, 19 composing the piezoelectric driving bodies 294, 304 comprise seven layers of the electrodes 18 and eight layers of the electrodes 19. As not shown, in these electrodes 18, 19, each piezoelectric driving body conducts via via-holes extending through the piezoelectric bodies 14 for each polarity in conformity to the above liquid droplet discharging piezoelectric devices 110, 111.

In the liquid droplet discharging piezoelectric device 120, the piezoelectric bodies 14 composing the piezoelectric driving bodies 294 present at the wall portions 32, 33 are polarized in, for example, directions from the electrodes 18 to the electrodes 19 (a polarized direction differs with each layer in accordance with the sandwiched electrode). Moreover, a power source is connected to a terminal electrode (not shown), and a driving electric field is applied between the electrodes 18 and 19 via the terminal electrode while an electrode 18 side is regarded as a positive electrode and an electrode 19 side is regarded as a negative electrode. In consequence, the electric field having the same direction as the polarized direction described above is formed. That is, the layered piezoelectric bodies 14 having mutually opposite polarized directions are laminated while the electrodes 18, 19 are sandwiched between the piezoelectric bodies. In each piezoelectric body 14, the polarization has the same direction as that of the driving electric field. As a result, an electrically inductive strain is developed in the piezoelectric body 14, the piezoelectric driving bodies 294 expand or contract substantially in a Z-direction in FIG. 12 based on displacements due to longitudinal effects of the bodies, and the wall portions expand or contract substantially in the Z-direction in FIG. 12 based on the displacements due to longitudinal effects of the portions (see FIG. 13(*b*)).

On the other hand, the piezoelectric bodies 14 composing the piezoelectric driving bodies 304 present at the wall portions 30, 31 are polarized in, for example, directions from the electrodes 19 to the electrodes 18, the directions being opposite to those of the piezoelectric bodies 14 composing the piezoelectric driving bodies 294. Moreover, the power source is connected to a terminal electrode (not shown), and a driving electric field is applied between the electrodes 18 and 19 via the terminal electrode while the electrode 18 side is regarded as the positive electrode and the electrode 19 side is regarded as the negative electrode. In consequence, the electric field having a polarized direction opposite to the above polarized direction is formed. That is, the piezoelectric bodies 14 composing the piezoelectric driving bodies 304 have a polarized direction opposite to a driving electric field direction, the electrically inductive strain is developed in the piezoelectric body 14, and the piezoelectric driving bodies 304 expand or contract substantially in a Y-direction in FIG. 12 based on displacements due to lateral effects of the bodies. The piezoelectric driving bodies expand or contract substantially in the Z-direction in FIG. 12 based on flexural displacements due to the lateral effects of the bodies (see FIG. 13(*b*)).

Since the above displacements of the piezoelectric bodies 14 directly use the electrically inductive strain, a large force is generated, and a high response speed is achieved. The individual layers do not develop large displacement amounts. However, since there are 14 layers of the piezoelectric bodies 14 sandwiched between the electrodes 18 and 19, the displacement amount is obtained in proportion to the number of the layers, and a large displacement can be obtained.

According to such a configuration, in the liquid droplet discharging piezoelectric device 120, all the wall portions 30, 31, 32 and 33 are displaced in the cavity member 321. Moreover, especially the displacement based on the longitudinal effect increases a pressure in the cavity 353, and generates a pressing force in the cavity 353. Furthermore, the liquid with which the cavity 353 is filled is discharged as droplets from the discharge port 7 by the pressing force of the cavity.

Figure 14:
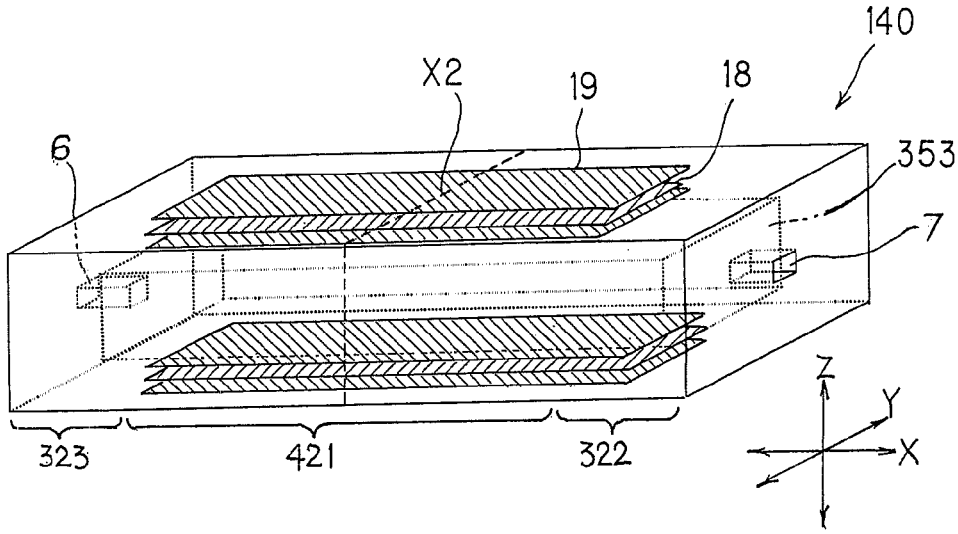
FIG. 14 is a diagram showing a further embodiment of the liquid droplet discharging piezoelectric device according to the present invention, and is a perspective view showing the inside.
Figure 15A:
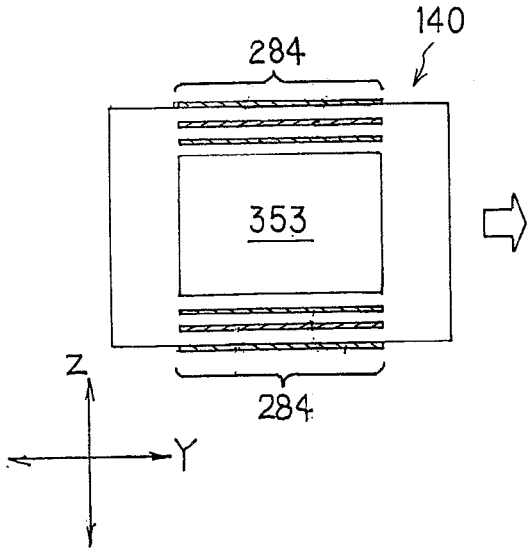
FIG. 15 is a sectional view showing a section cut along the X2 line of FIG. 14, (a) shows a state in which any electric field is not formed between a positive electrode and a negative electrode (a piezoelectric driving body is turned OFF) and (b) shows a state in which the electric field is formed between the positive electrode and the negative electrode (the piezoelectric driving body is turned ON)
Figure 15B:
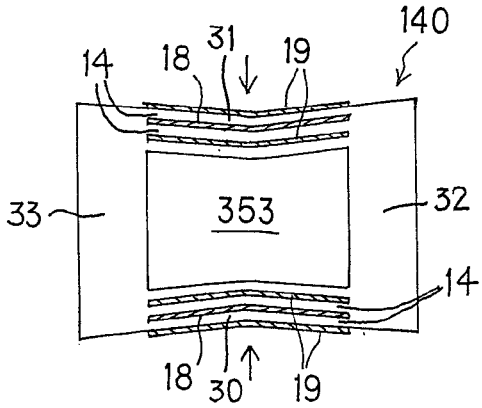

Next, FIGS. 14 and 15 are diagrams showing a further embodiment of the liquid droplet discharging piezoelectric device according to the present invention. FIG. 14 is a perspective view showing the inside, and FIGS. 15(*a*), (*b*) are sectional views showing a section cut along the X2 line of FIG. 14. FIG. 15(*a*) shows a state in which any electric field is not formed between a positive electrode and a negative electrode (a piezoelectric driving body is turned OFF), and FIG. 15(*b*) shows a state in which the electric field is formed between the positive electrode and the negative electrode (the piezoelectric driving body is turned ON).

A liquid droplet discharging piezoelectric device 140 shown in FIGS. 14 and 15 is different from the liquid droplet discharging piezoelectric device 120 in that in a cavity member formed of two sets of opposite wall portions and having a prismatic shape, one set of opposite wall portions comprises piezoelectric driving bodies, but the other set of wall portions comprises piezoelectric bodies only. Since the device has the same configuration as that of the liquid droplet discharging piezoelectric device 120 in the other respects, description thereof is omitted, and different respects will be described hereinafter.

In a cavity member 421 of the liquid droplet discharging piezoelectric device 140, electrodes 18, 19 are driving electrodes capable of applying an electric field to piezoelectric bodies 14 as a pair of electrodes, are wall portions 30, 31 and laminated on positions corresponding to a cavity 353, and comprise piezoelectric driving bodies 284 together with the piezoelectric bodies 14. The electrodes 18, 19 are not always present at corner portions of the cavity member 421. The electrodes 18, 19 are not exposed on a surface which forms the cavity 353 (see FIGS. 15(*a*), (*b*)). The electrodes 18, 19 being comprised in two piezoelectric driving bodies 284 arranged at the opposite wall portions comprise one layer of the electrode 18 and two layers of the electrodes 19 in the piezoelectric driving bodies 284, respectively. Although not shown, these electrodes 18, 19 conduct via via-holes extending through the piezoelectric bodies 14 for each polarity in conformity to the above liquid droplet discharging piezoelectric devices 110, 111.

In the cavity member 421 of the liquid droplet discharging piezoelectric device 140, the piezoelectric bodies 14 composing the piezoelectric driving bodies 284 present at the wall portions 30, 31 are polarized in, for example, directions from the electrodes 18 to the electrodes 19 (a polarized direction differs with each layer in accordance with the sandwiched electrode). Moreover, a power source is connected to a terminal electrode (not shown), and a driving electric field is applied between the electrodes 18 and 19 via the terminal electrode while an electrode 18 side is regarded as a positive electrode and an electrode 19 side is regarded as a negative electrode. In consequence, the electric field having the same direction as the polarized direction described above is formed. That is, the layered piezoelectric bodies 14 having mutually opposite polarized directions are laminated while the electrodes 18, 19 are sandwiched between the piezoelectric bodies. In each piezoelectric body 14, the polarization has the same direction as that of the driving electric field. As a result, an electrically inductive strain is developed in the piezoelectric body 14, and the piezoelectric driving bodies 284 expand or contract substantially in an X-direction in FIG. 14 based on displacements due to lateral effects of the bodies, and expand or contract substantially in a Z-direction in FIG. 14 based on displacements due to longitudinal effects of the bodies (see FIG. 15(*b*)). Since the displacements of such piezoelectric bodies 14 directly use the electrically inductive strain, a large force is generated, and a high response speed is achieved. On the other hand, wall portions 32, 33 where any piezoelectric driving body is not present do not deform (expand or contract).

According to such a configuration, in the liquid droplet discharging piezoelectric device 140, the wall portions 30, 31 are displaced in the cavity member 421. Moreover, especially the displacement based on the longitudinal effect increases a pressure in the cavity 353, and generates a pressing force in the cavity 353. The liquid with which the cavity 353 is filled is discharged as droplets from a discharge port 7 by the pressing force of the cavity.

Figure 16:
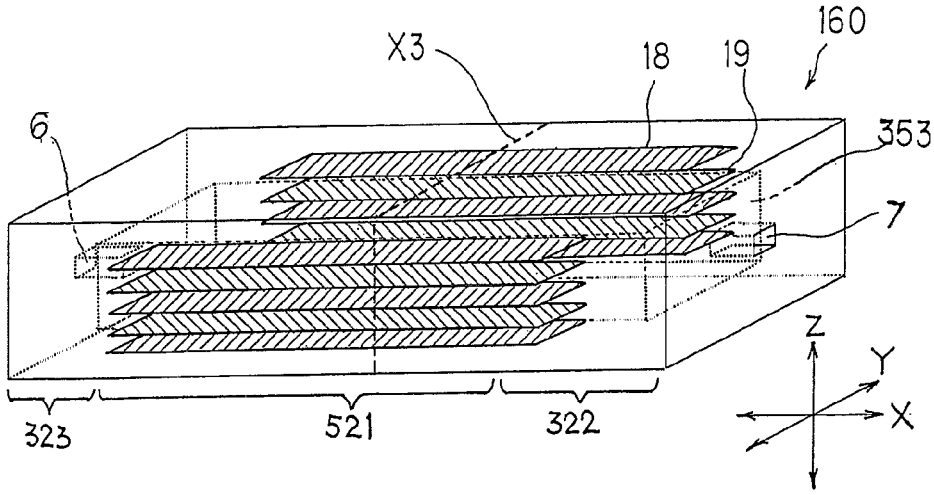
FIG. 16 is a diagram showing a further embodiment of the liquid droplet discharging piezoelectric device according to the present invention, and is a perspective view showing the inside.
Figure 17A:
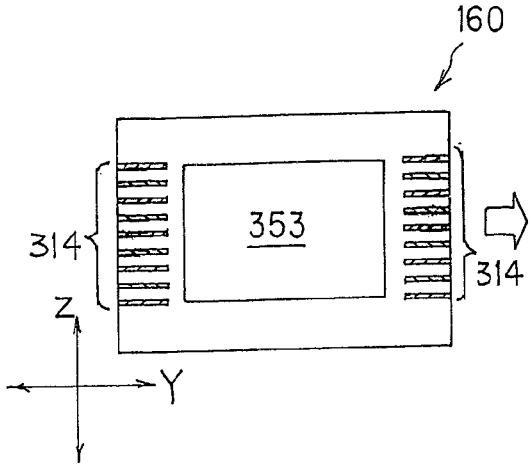
FIG. 17 is a sectional view showing a section cut along the X3 line of FIG. 16, (a) shows a state in which any electric field is not formed between a positive electrode and a negative electrode (a piezoelectric driving body is turned OFF) and (b) shows a state in which the electric field is formed between the positive electrode and the negative electrode (the piezoelectric driving body is turned ON)
Figure 17B:
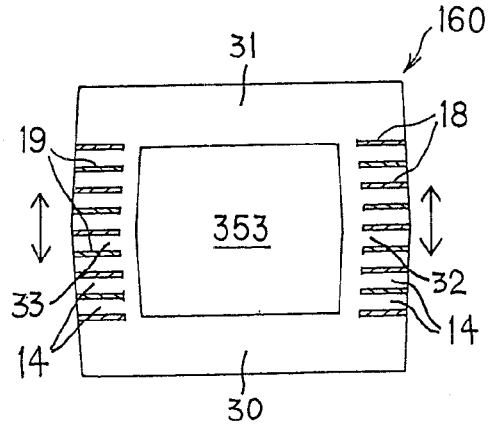

Next, FIGS. 16 and 17 are diagrams showing a further embodiment of the liquid droplet discharging piezoelectric device according to the present invention. FIG. 16 is a perspective view showing the inside, and FIGS. 17(*a*), (*b*) are sectional views showing a section cut along the X3 line of FIG. 16. FIG. 17(*a*) shows a state in which any electric field is not formed between a positive electrode and a negative electrode (a piezoelectric driving body is turned OFF), and FIG. 17(*b*) shows a state in which the electric field is formed between the positive electrode and the negative electrode (the piezoelectric driving body is turned ON). It is to be noted that in FIG. 16, a part of electrodes are omitted in order to facilitate understanding of the drawing.

A liquid droplet discharging piezoelectric device 160 shown in FIGS. 16 and 17 is different from the above liquid droplet discharging piezoelectric device 120 in that in a cavity member formed of two sets of opposite wall portions and having a prismatic shape, one set of opposite wall portions comprises piezoelectric driving bodies, but the other set of wall portions comprises piezoelectric bodies only. Since the device has the same configuration as that of the liquid droplet discharging piezoelectric device 120 in the other respects, description thereof is omitted, and different respects will be described hereinafter.

In a cavity member 521 of the liquid droplet discharging piezoelectric device 160, electrodes 18, 19 are driving electrodes capable of applying an electric field to piezoelectric bodies 14 as a pair of electrodes, are wall portions 32, 33 which are a set of wall portions opposite to those of the above liquid droplet discharging piezoelectric device 140 and laminated on positions corresponding to a cavity 353, and comprise piezoelectric driving bodies 314 together with piezoelectric bodies 14. The electrodes 18, 19 are not present at corner portions of the cavity member 521. The electrodes 18, 19 are not exposed on a surface which forms the cavity 353 (see FIGS. 17(*a*), (*b*)). The electrodes 18, 19 being comprised in the piezoelectric driving bodies 314 comprise four layers of the electrode 18 and five layers of the electrodes 19. Although not shown, these electrodes 18, 19 conduct via via-holes extending through the piezoelectric bodies 14 for each polarity in conformity to the above liquid droplet discharging piezoelectric devices 110, 111.

In the cavity member 521 of the liquid droplet discharging piezoelectric device 160, wall portions 32, 33 comprise the piezoelectric driving bodies 314. Moreover, the piezoelectric bodies 14 composing the piezoelectric driving bodies 314 are polarized in, for example, directions from the electrodes 18 to the electrodes 19 (a polarized direction differs with each layer in accordance with the sandwiched electrode). A power source is connected to a terminal electrode (not shown), and a driving electric field is applied between the electrodes 18 and 19 via the terminal electrode while an electrode 18 side is regarded as a positive electrode and an electrode 19 side is regarded as a negative electrode. In consequence, the electric field having the same direction as the polarized direction described above is formed. That is, the layered piezoelectric bodies 14 having mutually opposite polarized directions are laminated while the electrodes 18, 19 are sandwiched between the piezoelectric bodies. In each piezoelectric body 14, the polarization has the same direction as that of the driving electric field. As a result, an electrically inductive strain is developed in the piezoelectric body 14, and the piezoelectric driving bodies 314 expand or contract substantially in an X-direction in FIG. 16 based on displacements due to lateral effects of the bodies, and expand or contract substantially in a Z-direction in FIG. 16 based on displacements due to longitudinal effects of the bodies (see FIG. 17(*b*)). Since the displacements of such piezoelectric bodies 14 directly use the electrically inductive strain, a large force is generated, and a high response speed is achieved. On the other hand, wall portions 30, 31 where any piezoelectric driving body is not present do not deform (expand or contract).

According to such a configuration, in the liquid droplet discharging piezoelectric device 160, the wall portions 32, 33 are displaced in the cavity member 521. Moreover, especially the displacement based on the longitudinal effect increases a pressure in the cavity 353, and generates a pressing force in the cavity 353. Moreover, the liquid with which the cavity 353 is filled is discharged as droplets from a discharge port 7 by the pressing force of the cavity.

Figure 18A:
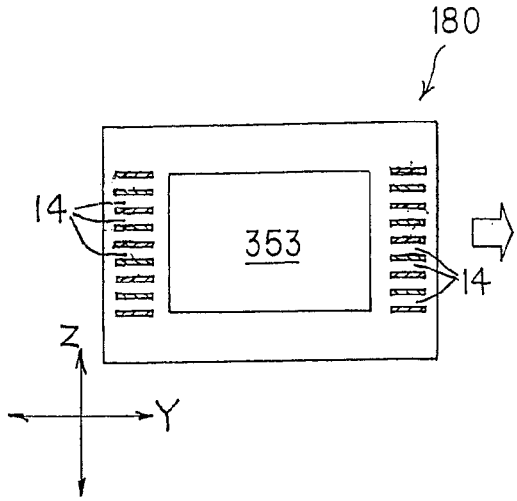
FIG. 18 is a diagram showing a further embodiment of the liquid droplet discharging piezoelectric device according to the present invention, (a) shows a state in which any electric field is not formed between a positive electrode and a negative electrode (a piezoelectric driving body is turned OFF) and (b) shows a state in which the electric field is formed between the positive electrode and the negative electrode (the piezoelectric driving body is turned ON)
Figure 18B:
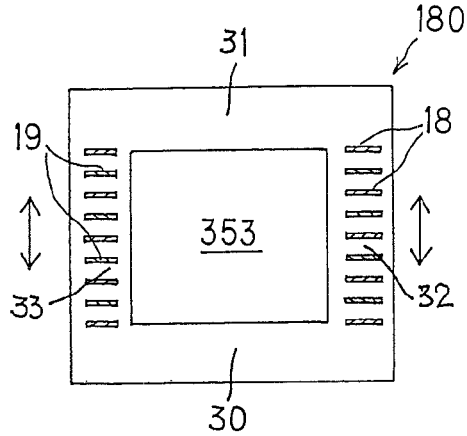

Next, FIG. 18 is a diagram showing a further embodiment of the liquid droplet discharging piezoelectric device according to the present invention. FIGS. 18(*a*), (*b*) are sectional views of the liquid droplet discharging piezoelectric device, corresponding to FIGS. 17(*a*), (*b*). FIG. 18(*a*) shows a state in which any electric field is not formed between a positive electrode and a negative electrode (a piezoelectric driving body is turned OFF), and FIG. 18(*b*) shows a state in which the electric field is formed between the positive electrode and the negative electrode (the piezoelectric driving body is turned ON). A liquid droplet discharging piezoelectric device 180 shown in FIG. 18 is different from the above liquid droplet discharging piezoelectric device 160 (in the piezoelectric driving bodies 314 of the liquid droplet discharging piezoelectric device 160, electrodes 18, 19 are exposed on an outer surface (see FIGS. 17(*a*), (*b*))) in that the electrodes 18, 19 being comprised in the piezoelectric driving body are not exposed on the outer surface in addition to a surface (inner surface) forming a cavity 353, and an insulating property of the outer surface of the liquid droplet discharging piezoelectric device is improved. Since the liquid droplet discharging piezoelectric device 180 has the same configuration as that of the liquid droplet discharging piezoelectric device 160 in the other respects, description is omitted.

Figure 19:
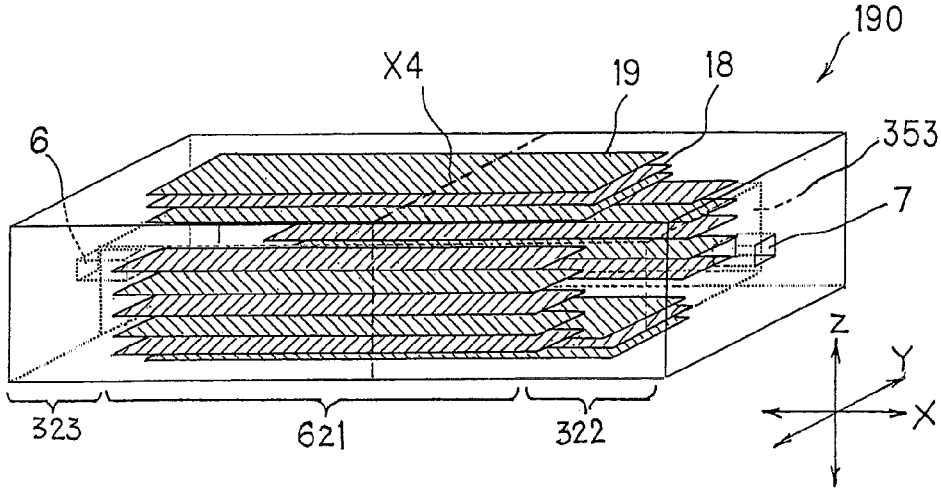
FIG. 19 is a diagram showing a further embodiment of the liquid droplet discharging piezoelectric device according to the present invention, and is a perspective view showing the inside.
Figure 20A:
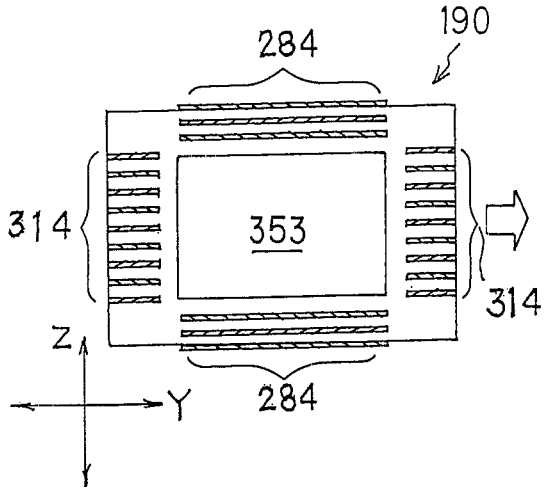
FIG. 20 is a sectional view showing a section cut along the X4 line of FIG. 19, (a) shows a state in which any electric field is not formed between a positive electrode and a negative electrode (a piezoelectric driving body is turned OFF) and (b) shows a state in which the electric field is formed between the positive electrode and the negative electrode (the piezoelectric driving body is turned ON)
Figure 20B:
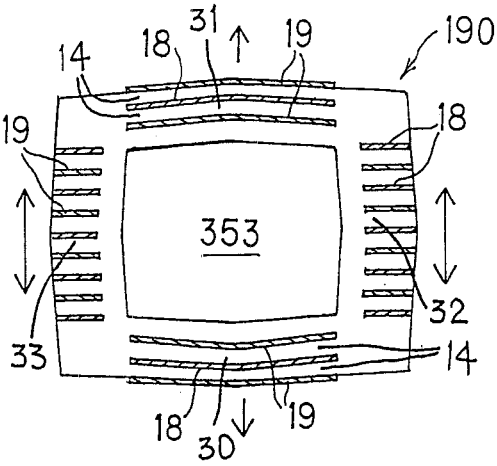

Next, FIGS. 19 and 20 are diagrams showing a further embodiment of the liquid droplet discharging piezoelectric device according to the present invention. FIG. 19 is a perspective view showing the inside, and FIGS. 20(*a*), (*b*) are sectional views showing a section cut along the X4 line of FIG. 19. FIG. 20(*a*) shows a state in which any electric field is not formed between a positive electrode and a negative electrode (a piezoelectric driving body is turned OFF), and FIG. 20(*b*) shows a state in which the electric field is formed between the positive electrode and the negative electrode (the piezoelectric driving body is turned ON). It is to be noted that a part of electrodes are omitted in order to facilitate understanding of the drawing.

A liquid droplet discharging piezoelectric device 190 shown in FIGS. 19 and 20 is a liquid droplet discharging piezoelectric device in which in a cavity member having a prismatic shape formed of two sets of opposite wall portions, two sets of opposite wall portions both comprise piezoelectric driving bodies, and the piezoelectric driving bodies 284 of the above liquid droplet discharging piezoelectric device 140 and the piezoelectric driving bodies 314 of the liquid droplet discharging piezoelectric device 160 comprise the wall portions of the cavity member. It can be said that the liquid droplet discharging piezoelectric device 190 has a configuration in which electrodes 18, 19 are removed from corner portions of the cavity member 321 of the above liquid droplet discharging piezoelectric device 120 (see FIGS. 12 and 13(*a*), (*b*)). The liquid droplet discharging piezoelectric device 190 has the same configuration as that of the above liquid droplet discharging piezoelectric device 120 in the other respects. Moreover, polarization of piezoelectric bodies in the piezoelectric driving body, an electric field applied between a positive electrode and a negative electrode, configuration of expansion or contraction (deformation) of the piezoelectric driving body based on them and the like also conform to those of the liquid droplet discharging piezoelectric device 120. Therefore, description thereof is omitted from the following.

Figure 21A:
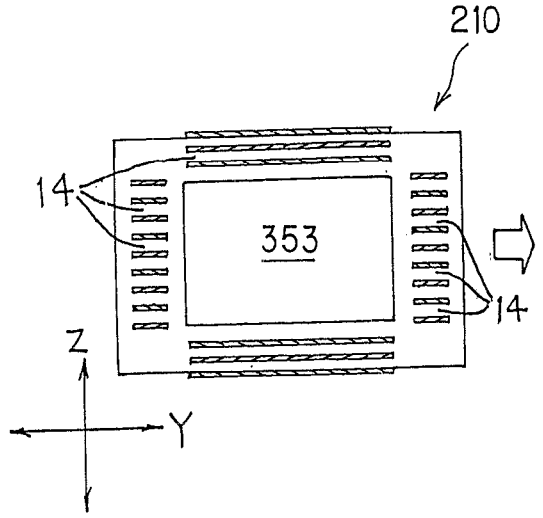
FIG. 21 is a diagram showing a further embodiment of the liquid droplet discharging piezoelectric device according to the present invention, (a) shows a state in which any electric field is not formed between a positive electrode and a negative electrode (a piezoelectric driving body is turned OFF) and (b) shows a state in which the electric field is formed between the positive electrode and the negative electrode (the piezoelectric driving body is turned ON)
Figure 21B:
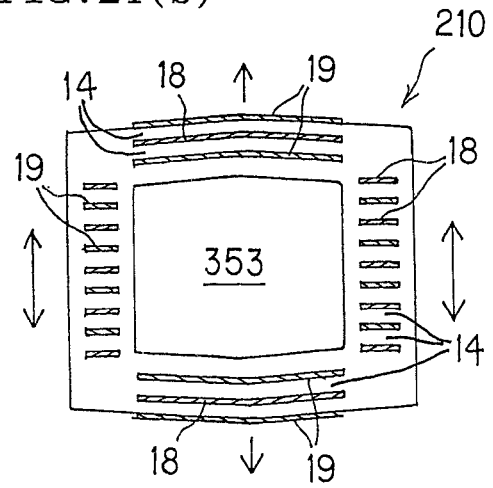

Next, FIG. 21 is a diagram showing a further embodiment of the liquid droplet discharging piezoelectric device according to the present invention. FIGS. 21(*a*), (*b*) are sectional views of the liquid droplet discharging piezoelectric device, corresponding to FIGS. 20(*a*), (*b*). FIG. 21(*a*) shows a state in which any electric field is not formed between a positive electrode and a negative electrode (a piezoelectric driving body is turned OFF), and FIG. 21(*b*) shows a state in which the electric field is formed between the positive electrode and the negative electrode (the piezoelectric driving body is turned ON). A liquid droplet discharging piezoelectric device 210 shown in FIG. 21 is different from the liquid droplet discharging piezoelectric device 190 (in the piezoelectric driving bodies 314 of the liquid droplet discharging piezoelectric device 190, electrodes 18, 19 are exposed on an outer surface (see FIGS. 20(*a*), (*b*))) in that the electrodes 18, 19 being comprised in the piezoelectric driving bodies are not exposed on the outer surface in addition to a surface (inner surface) forming a cavity 353, and an insulating property of the outer surface of the liquid droplet discharging piezoelectric device is improved. Since the liquid droplet discharging piezoelectric device 210 has the same configuration as that of the liquid droplet discharging piezoelectric device 190 (i.e., substantially the same configuration as that of the liquid droplet discharging piezoelectric device 120) in the other respects, description is omitted.

Figure 22:
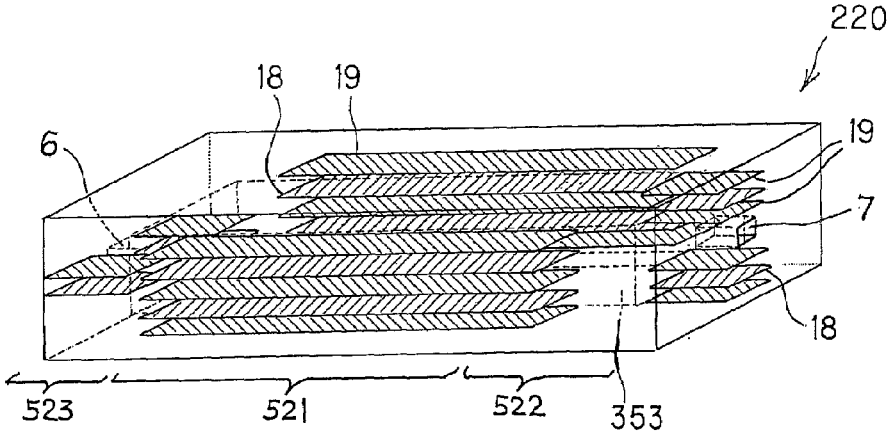
FIG. 22 is a diagram showing a still further embodiment of the liquid droplet discharging piezoelectric device according to the present invention, and is a perspective view showing the inside.

Next, FIG. 22 is a diagram showing a still further embodiment of the liquid droplet discharging piezoelectric device according to the present invention, and is a perspective view showing the inside. In the same manner as in the above liquid droplet discharging piezoelectric device 160 (see FIG. 16), a liquid droplet discharging piezoelectric device 220 shown in FIG. 22 has a cavity member having a prismatic shape formed of two sets of opposite wall portions, in which one set of opposite wall portions comprises piezoelectric driving bodies, but the other set of wall portions comprises piezoelectric bodies only (in FIG. 22, to facilitate understanding of the drawing, a part of electrodes are omitted). Moreover, in the liquid droplet discharging piezoelectric device 220, an introduction member and a nozzle member also include piezoelectric driving bodies.

The liquid droplet discharging piezoelectric device 220 includes a cavity member 521 in which a cavity 353 is built; an introduction member 523 having an introduction channel which connects with the cavity 353; and a nozzle member 522 having a nozzle channel which connects with the cavity 353 on a side opposite to the introduction channel. The cavity member 521 has a prismatic shape, and the cavity 353 having a rectangular sectional shape is formed by two sets of opposite wall portions. The introduction member 523 is provided with an introduction port 6 to introduce a liquid into the cavity 353 via the introduction channel. The nozzle member 522 is provided with a discharge port 7 to discharge the liquid with which the cavity 353 has been filled as droplets via the nozzle channel.

In the liquid droplet discharging piezoelectric device 220, the cavity member 521, the introduction member 523 and the nozzle member 522 are all composed by laminating nine layers of piezoelectric bodies 14 made of a ceramic material, and integrally formed by sintering. A liquid flow direction crosses a laminating direction at right angles. Moreover, in the cavity member 521 having the prismatic shape formed of two sets of opposite wall portions, one set of opposite wall portions in a width direction (a horizontal direction in FIG. 22) comprises piezoelectric driving bodies, but the other set of wall portions comprises piezoelectric bodies only.

In the same manner as in the cavity member 521, the introduction member 523 has a prismatic shape, and an introduction channel smaller (thinner) than the cavity 353 is formed by two sets of opposite wall portions. In two sets of opposite wall portions, the wall portions opposing to each other in the width direction comprises piezoelectric driving bodies in the same manner as in the cavity member 521, but the other set of wall portions comprises piezoelectric bodies only. Moreover, in the same manner as in the cavity member 521, the nozzle member 522 also has a prismatic shape, a nozzle channel smaller (thinner) than the cavity 353 is formed by two sets of opposite wall portions. Unlike the cavity member 521 and the introduction member 523, in two sets of opposite wall portions, wall portions opposing to each other in a laminating direction (a direction vertical to the width direction) comprise piezoelectric driving bodies, but the wall portions opposing to each other in the width direction comprise piezoelectric bodies only. That is, in the cavity member 521, the introduction member 523 and the nozzle member 522, the cavity member 521 is provided with the wall portions composing the piezoelectric driving bodies arranged in the same positions as those of the introduction member 523, and the wall portions are arranged in different positions in the only nozzle member 522.

Since the liquid droplet discharging piezoelectric device 220 has the above configuration, electrode wiring lines are arranged so that the piezoelectric driving bodies of the cavity member 521, the introduction member 523 and the nozzle member 522 can be driven in common. In consequence, a pressure in the cavity 353 of the cavity member 521 can efficiently be applied to the nozzle channel of the nozzle member 522. Since the common electrode wiring lines are arranged, the piezoelectric driving bodies of the cavity member 521 expand or contract (deform) in the same manner as in the introduction member 523, and a time to expand or contract the cavity 353 and the introduction channel can be allowed to deviate from a time to expand or contract the nozzle channel. That is, at a time to introduce a liquid, the piezoelectric driving body is deformed so as to contract the nozzle channel in the nozzle member 522, and the piezoelectric driving body is deformed so as to expand the cavity 353 in the cavity member 521. Similarly in the introduction member 523, the piezoelectric driving body is deformed so as to expand the introduction channel. Moreover, at a time to discharge a liquid, the piezoelectric driving body is deformed so as to expand the nozzle channel in the nozzle member 522, and the piezoelectric driving body is deformed so as to contract the cavity 353 in the cavity member 521. Similarly in the introduction member 523, the piezoelectric driving body is deformed so as to contract the introduction channel. In the liquid droplet discharging piezoelectric device 220, especially the displacement based on a longitudinal effect increases the pressure in the cavity 353 to generate a pressing force in the cavity 353. According to the above operation, the pressing force is efficiently used as a force to discharge the liquid with which the cavity 353 is filled as the droplets from the discharge port 7. When electrodes 18, 19 of the piezoelectric driving bodies are independently driven, in addition to the above effect, it is possible to provide a function of constricting the liquid after discharged to cut the liquid as a droplet.

Figure 24:
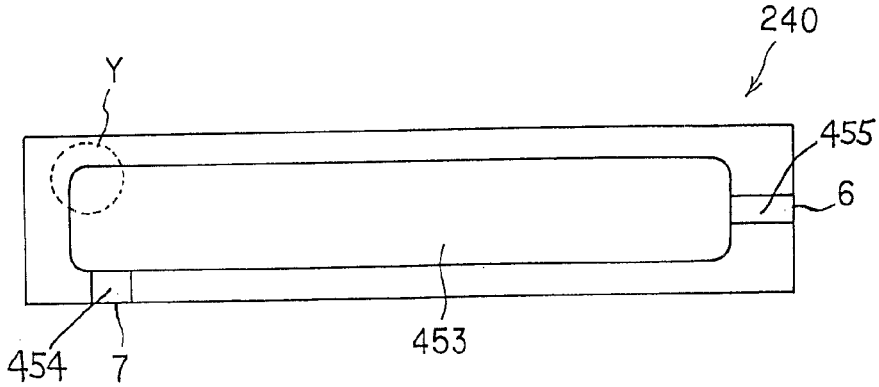
FIG. 24 is a sectional view showing a conventional liquid droplet discharging piezoelectric device.

The embodiments of the liquid droplet discharging piezoelectric device according to the present invention have been described above, but the above liquid droplet discharging piezoelectric devices shown in FIGS. 1 to 22 are common in that the introduction channel of the introduction member, the cavity of the cavity member and the nozzle channel of the nozzle member are linearly arranged. According to such a configuration, the liquid satisfactorily flows, and bubbles are easily removed during the introducing of the liquid (filling). In a liquid droplet discharging piezoelectric device 240 shown in FIG. 24, since a discharge port 7 is not disposed in a position symmetric with respect to an introduction port 6 centering on a cavity 453, an introduction channel 455, the cavity 453 and a nozzle channel 454 are not linearly arranged.

A liquid flow is hindered in a corner portion (e.g., a circled portion denoted with Y in FIG. 24) of the cavity 453, and there is a fear that bubbles may be accumulated. However, according to the above-described embodiments of the liquid droplet discharging piezoelectric device of the present invention, such a problem can be avoided.

It is to be noted that in the descriptions of the above embodiments of the liquid droplet discharging piezoelectric device according to the present invention, the liquid enters the introduction member from the introduction port, is introduced into the cavity via the introduction channel, and is discharged as the droplets from the discharge port via the nozzle channel of the nozzle member. However, in the liquid droplet discharging piezoelectric device according to the present invention, the liquid may be sucked from the discharge port, and the nozzle channel and the cavity may be filled with the liquid to prepare for the next discharge. In a case where they are filled with the liquid in this manner, since the liquid is sucked from the discharge port to prepare for the next discharge, any introduction member is not used. When such an operation is realized, it is preferable to vibrate the cavity member and suck the liquid from the discharge port by the displacement of the piezoelectric driving body composing at least a part of the cavity member based on the electrically inductive strain.

Figure 23:
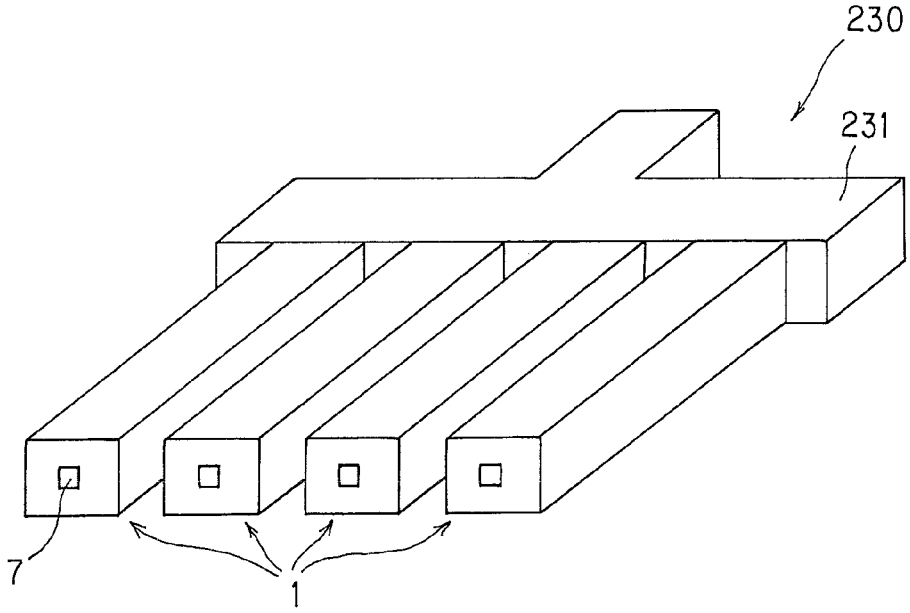
FIG. 23 is a diagram showing an application example of the liquid droplet discharging piezoelectric device according to the present invention, and is a perspective view showing an example in which an inline type dispenser is formed.

Next, an application example of the liquid droplet discharging piezoelectric device according to the present invention will be described. FIG. 23 is a perspective view showing an example in which an inline type dispenser is composed using the liquid droplet discharging piezoelectric device according to the present invention. An inline type dispenser 230 shown in FIG. 23 is a dispenser having a comb tooth shape in which four liquid droplet discharging piezoelectric devices 1 shown in FIG. 1 are arranged in parallel to compose a comb tooth portion, and a comb frame portion 231 is used as a header tube. In the inline type dispenser 230, channels (not shown) in the comb frame portion 231 are connected to introduction ports 6 of the liquid droplet discharging piezoelectric devices 1. A liquid is supplied from the side of a comb frame portion 231 to the liquid droplet discharging piezoelectric devices 1, and the liquid droplet discharging piezoelectric devices 1 can be operated to discharge liquid droplets.

Next, a method of manufacturing the liquid droplet discharging piezoelectric device and a material for use according to the present invention will be described. To manufacture the liquid droplet discharging piezoelectric device according to the present invention, as described later, it is preferable to mainly use a green sheet laminating process and use a punching process as accessory means. It is to be noted that a preparation object is the liquid droplet discharging piezoelectric device 1 shown in FIGS. 1(*a*) to (*d*) in description, and manufacturing steps are not shown in the drawing, but the method and the material will appropriately be described with reference to FIGS. 1(*a*) to (*d*) showing a configuration after manufactured.

The manufacturing steps will be described hereinafter. First, five ceramic green sheets mainly composed of a piezoelectric material are prepared. The ceramic green sheets (hereinafter referred to simply as the sheets) can be prepared by a molding method heretofore known. For example, powder of the piezoelectric material is used, and this powder is blended with a binder, a solvent, a dispersant, a plasticizer or the like in a desired composition to prepare a slurry. After a defoaming treatment of this slurry, it is possible to prepare the ceramic green sheets by a sheet forming process such as a doctor blade process, a reverse roll coater process or a reverse doctor roll coater process.

There is not any restriction on the piezoelectric material as long as the material causes an electrically inductive strain such as a piezoelectric effect. The material may be crystalline or amorphous. Alternatively, a semiconductor ceramic material, a ferroelectric ceramic material or an antiferroelectric ceramic material may be used. The material may appropriately be selected for use in accordance with an application. Alternatively, the material may or may not require a polarization treatment.

Specifically, examples of a preferable material include lead zirconate, lead titanate, lead magnesium niobate, lead nickel niobate, lead nickel tantalate, lead zinc niobate, lead manganese niobate, lead antimony stannate, lead manganese tungstate, lead cobalt niobate, lead magnesium tungstate, lead magnesium tantalate, barium titanate, sodium bismuth titanate, bismuth neodymium titanate (BNT), potassium sodium niobate, strontium bismuth tantalate, copper tungsten barium, bismuth ferrate, and a composite oxide consisting of two or more of them. Moreover, in this material, there may be dissolved an oxide of lanthanum, calcium, strontium, molybdenum, tungsten, barium, niobium, zinc, nickel, manganese, cerium, cadmium, chromium, cobalt, antimony, iron, yttrium, tantalum, lithium, bismuth, tin, copper or the like. Furthermore, a material obtained by adding lithium bismuthate, lead germanate or the like to the above material or the like, such as a material obtained by adding lithium bismuthate and/or lead germanate to the composite oxide of lead zirconate, lead titanate and lead magnesium niobate is preferable because a high material characteristic can be developed while sintering of the piezoelectric body at a low temperature is realized.

After preparing five ceramic green sheets, all the five ceramic green sheets are processed into shapes (substantially strip shapes, (refer to FIG. 1(*a*)) corresponding to the piezoelectric bodies 14 of the liquid droplet discharging piezoelectric devices 1, and five processed sheets are obtained (processed sheets A to E). In one processed sheet C of the five processed sheets A to E, further hole portions composing later the cavity 3, the nozzle channel 4 and the introduction channel 5 are made, and the sheet C provided with the hole portions is obtained. Moreover, on one surface of each of two processed sheets A, E and one sheet C provided with the hole portions, a conductive film composing the electrode 18 later is formed using a predetermined pattern, and a conductive film composing the electrode 19 later is formed on (for example) the back surface of the process sheet A. Further on one surface of each of the remaining two processed sheets B, D, a conductive film composing the electrode 19 later is formed using a predetermined pattern. It is to be noted that as means for forming the conductive film, a screen printing process is preferably used, but means such as photolithography may be performed. The predetermined pattern of the conductive film is a pattern in which any conductive film is not formed on an end portion of the processed sheet in a longitudinal direction. Moreover, the end portion of the sheet in the longitudinal direction on which the conductive film composing the electrode 18 later is to be formed is different from that of the sheet in the longitudinal direction on which the conductive film composing the electrode 19 later is to be formed (see FIG. 1(*b*)).

As a material of the conductive film (the electrode), a conductive metal which is solid at room temperature is used. It is preferable to use a single metal such as aluminum, titanium, chromium, iron, cobalt, nickel, copper, zinc, niobium, molybdenum, ruthenium, palladium, rhodium, silver, tin, tantalum, tungsten, iridium, platinum, gold or lead, or an alloy of two or more of them such as silver-platinum, platinum-palladium or silver-palladium. It is preferable to use one type of alloy alone or a combination of two or more types of alloys.

Alternatively, a mixture of such a material with aluminum oxide, zirconium oxide, titanium oxide, silicon oxide, cerium oxide, glass, a piezoelectric material or the like, or a cermet may be used. When these materials are selected, it is preferable to select the material in accordance with a type of the piezoelectric material.

Next, the processed sheets A, B, the sheet C provided with the hole portions and the processed sheets D, E on which the conductive films have been formed are laminated while disposing the sheet C provided with the hole portions in the middle. The sheets are brought into contact under pressure with one another to obtain a ceramic green laminate body having a predetermined thickness (for a state of lamination, refer to FIG. 1(*b*) showing the liquid droplet discharging piezoelectric device 1 as a preparation object). At this time, for a purpose of improving a laminated state (integrity) of the green sheets, it is preferable to form an auxiliary bonding layer on the green sheet beforehand. Subsequently, after forming conductive films composing the outer electrodes 28, 29 later, the films are sintered and integrated to obtain a sintered laminate body. Subsequently, if necessary, the polarization treatment is performed to obtain the liquid droplet discharging piezoelectric device 1.

It is to be noted that in the present description, it is simply described that the liquid droplet discharging piezoelectric device 1 is piezoelectric, but the piezoelectric driving body mentioned in the present description indicates all driving bodies that utilize a strain induced by the electric field. The piezoelectric driving body is not limited to the driving body utilizing a piezoelectric effect to generate a strain amount substantially proportional to an applied electric field in a narrow sense. The piezoelectric driving body also includes a driving body utilizing an electrostrictive effect to generate a strain amount substantially in proportion to a square of the applied electric field, and a driving body utilizing a phenomenon such as polarization reverse seen in a general ferroelectric material or an antiferroelectric phase-ferroelectric phase transition seen in an antiferroelectric material.

INDUSTRIAL APPLICABILITY

A liquid droplet discharging piezoelectric device according to the present invention can preferably be utilized in a mixing and reacting operation of a micro amount of liquid in a biotechnology field, manufacturing of DNA chip necessary for analysis of genetic structure, a micro liquid droplet discharge device for use in a coating step for manufacturing a semiconductor, a micro amount projection device of a reagent for use in various inspections in a medical field or the like.

The invention claimed is:

1. A liquid droplet discharging piezoelectric device for use in discharging micro liquid droplets provided with:

a cavity member in which a cavity to be filled with a liquid is built;

an introduction member having an introduction channel which connects with the cavity and an introduction port from which the liquid is introduced into the cavity via the introduction channel; and a nozzle member having a nozzle channel which connects with the cavity on a side of the cavity member opposite to the introduction channel and a discharge port to discharge the liquid with which the cavity has been filled as droplets via the nozzle channel, wherein at least a part of the cavity member comprises a piezoelectric driving body in which a plurality of layered piezoelectric bodies made of a ceramic material and a plurality of layered electrodes are alternately laminated, at least a part of the introduction member and/or the nozzle member comprises a piezoelectric body made of the ceramic material, and the cavity member, the introduction member and/or the nozzle member is integrally formed by sintering, and wherein a displacement based on an electrically inductive strain of the piezoelectric driving body composing at least a part of the cavity member generates a pressing force accompanied by an increase of a pressure in the cavity of the cavity member; and the liquid with which the cavity has been filled is discharged as droplets from the discharge port by use of the pressing force.

2. The liquid droplet discharging piezoelectric device according to claim 1, wherein in a case where at least a part of the introduction member comprises the piezoelectric bodies made of the ceramic material, the piezoelectric bodies are the plurality of layered piezoelectric bodies; and the plurality of layered piezoelectric bodies and the plurality of layered electrodes are alternately laminated to compose the piezoelectric driving body.

3. The liquid droplet discharging piezoelectric device according to claim 1, wherein in a case where at least a part of the nozzle member comprises the piezoelectric bodies made of the ceramic material, the piezoelectric bodies are the plurality of layered piezoelectric bodies; and the plurality of layered piezoelectric bodies and the plurality of layered electrodes are alternately laminated to compose the piezoelectric driving body.

4. The liquid droplet discharging piezoelectric device according to claim 1, wherein the whole cavity member comprises the piezoelectric driving body.

5. The liquid droplet discharging piezoelectric device according to claim 4, wherein a section of the cavity incorporated in the cavity member vertical to a flow direction of the liquid has a rectangular shape.

6. The liquid droplet discharging piezoelectric device according to claim 1, wherein the cavity member has a prismatic shape; the cavity is formed by two sets of opposite wall portions; one set of opposite wall portions comprises the piezoelectric driving bodies; and the other set of wall portions comprises the piezoelectric bodies only.

7. The liquid droplet discharging piezoelectric device according to claim 6, wherein the introduction member further has a prismatic shape, the introduction channel is formed by two sets of opposite wall portions, one set of opposite wall portions comprises the piezoelectric driving bodies, the other set of wall portions comprises the piezoelectric bodies only;

the nozzle member has a prismatic shape, the nozzle channel is formed by two sets of opposite wall portions, one set of opposite wall portions comprises the piezoelectric driving bodies, the other set of wall portions comprises the piezoelectric bodies only; and in the cavity member, the introduction member and the nozzle member, one set of opposite wall portions comprising the piezoelectric driving bodies in the cavity member are arranged in the same positions as those in the introduction member, and the wall portions in the nozzle member only are arranged in different positions.

8. The liquid droplet discharging piezoelectric device according to claim 6, wherein in the wall portion comprising the piezoelectric driving body among the two sets of opposite wall portions, the layered electrodes stand back from a surface forming the cavity and are not exposed in the surface forming the cavity, the surface forming the cavity comprises the layered piezoelectric bodies only; and a ratio between a distance from the surface forming cavity to the layered electrodes and a thickness of one layer of the layered piezoelectric bodies is in a range of 5:1 to 1:10.

9. The liquid droplet discharging piezoelectric device according to claim 1, wherein the cavity member has a prismatic shape; the cavity is formed by two sets of opposite wall portions; and the two sets of opposite wall portions both comprise the piezoelectric driving bodies.

10. The liquid droplet discharging piezoelectric device according to claim 9, wherein when the two sets of opposite wall portions both comprise the piezoelectric driving bodies, a polarized direction of the piezoelectric bodies of the piezoelectric driving bodies composing one set of opposite wall portions is different from that of the piezoelectric bodies of the piezoelectric driving bodies composing the other set of opposite wall portions.

11. The liquid droplet discharging piezoelectric device according to claim 9, wherein any of the two sets of opposite wall portions both comprising the piezoelectric driving bodies is provided with a slit which partially separates the piezoelectric driving bodies composing one set of opposite wall portions from the piezoelectric driving bodies composing the other set of opposite wall portions.

12. The liquid droplet discharging piezoelectric device according to claim 1, wherein all of the cavity member, the introduction member and the nozzle member are integrally formed by laminating the plurality of layered piezoelectric bodies made of the ceramic material: and the cavity of the cavity member, the introduction channel of the introduction member and the nozzle channel of the nozzle member are formed by the same layer of the laminated piezoelectric bodies.

13. The liquid droplet discharging piezoelectric device according to claim 1, wherein a section of the nozzle channel of the nozzle member vertical to the liquid flow direction is smaller than a section of the cavity of the cavity member vertical to the liquid flow direction.

14. The liquid droplet discharging piezoelectric device according to claim 13, wherein a size of the section of the cavity of the cavity member is continuously reduced on a nozzle channel side of the cavity to smoothly connect the cavity to the nozzle channel of the nozzle member.

15. The liquid droplet discharging piezoelectric device according to claim 1, wherein the section of the nozzle channel of the nozzle member vertical to the liquid flow direction has a rectangular or trapezoidal shape.

16. The liquid droplet discharging piezoelectric device according to claim 1, wherein a ratio d/L between the shortest distance d in the section of the nozzle channel of the nozzle member and a length L of the nozzle channel is 0.08 to 0.8.

17. The liquid droplet discharging piezoelectric device according to claim 1, wherein a surface roughness of an end surface of the nozzle member on a discharge port side is smaller than at least a surface roughness of the nozzle channel of the nozzle member.

18. The liquid droplet discharging piezoelectric device according to claim 1, wherein a section of the introduction channel of the introduction member vertical to the liquid flow direction is smaller than that of the cavity of the cavity member vertical to the liquid flow direction; and a size of the section of the cavity of the cavity member is continuously reduced in a width direction with respect to the liquid flow direction on an introduction channel side of the cavity to smoothly connect the cavity to the introduction channel of the introduction member.

19. The liquid droplet discharging piezoelectric device according to claim 1, wherein the section of the introduction channel of the introduction member vertical to the liquid flow direction has a rectangular or trapezoidal shape.

20. The liquid droplet discharging piezoelectric device according to claim 1, wherein the introduction channel of the introduction member comprises a porous body having a gas liquid separating function.

21. The liquid droplet discharging piezoelectric device according to claim 1, wherein the introduction member includes, on an introduction port side of the introduction channel, an introduction cavity which connects with the introduction channel and whose section vertical to the liquid flow direction is larger than the section of the introduction channel.

22. The liquid droplet discharging piezoelectric device according to claim 1, wherein the introduction member comprises a flange portion to be attached to an apparatus to which the liquid droplet discharging piezoelectric device is to be applied; and at least an end surface of the introduction member on the introduction port side is larger than the section of the cavity member vertical to the liquid flow direction.

23. The liquid droplet discharging piezoelectric device according to claim 1, wherein the cavity of the cavity member, the nozzle channel of the nozzle member and the introduction channel of the introduction member have sections having the same shape and an equal width in the width direction with respect to the liquid flow direction; and the sections are continuously connected to one another.

24. The liquid droplet discharging piezoelectric device according to claim 1, wherein micro liquid droplets have a liquid amount of a nanoliter (nl) order.

25. The liquid droplet discharging piezoelectric device according to claim 1, wherein any electrode is not exposed on the end surface of the introduction member on the introduction port side, the surface forming introduction channel of the introduction member, a surface forming cavity of the cavity member, a surface forming nozzle channel of the nozzle member and the end surface of the nozzle member on the discharge port side.

26. The liquid droplet discharging piezoelectric device according to claim 1, wherein the liquid flow direction crosses, at right angles, a laminating direction of the plurality of layered piezoelectric bodies forming the piezoelectric driving body.

27. The liquid droplet discharging piezoelectric device according to claim 1, wherein the electrodes are disposed on opposite outermost layers in the piezoelectric driving body composed by alternately laminating the plurality of layered piezoelectric bodies and the plurality of layered electrodes; and the electrode of one outermost layer has a polarity different from that of the electrode of the other outermost layer.

* * * * *